United States Patent [19]

Ashworth, Jr.

[11] 4,152,693

[45] May 1, 1979

[54] VEHICLE LOCATOR SYSTEM

[75] Inventor: Charles S. Ashworth, Jr., Warren, Mich.

[73] Assignee: Audio Alert, Inc., Farmington Hills, Mich.

[21] Appl. No.: 790,265

[22] Filed: Apr. 25, 1977

[51] Int. Cl.[2] ..... G08G 1/12

[52] U.S. Cl. ..... 340/24; 340/23; 364/460

[58] Field of Search ..... 340/23, 25, 24; 364/443, 436, 460, 424; 325/53, 117

[56] References Cited

U.S. PATENT DOCUMENTS

| | | | |
|---|---|---|---|
| 3,568,161 | 3/1971 | Knickel | 340/24 |
| 3,783,445 | 1/1974 | Penwarden | 340/24 |
| 3,984,807 | 10/1976 | Haemmig | 340/23 |
| 3,986,119 | 10/1976 | Hemmer et al. | 340/24 |
| 4,009,375 | 2/1977 | White et al. | 340/23 |

*Primary Examiner*—John W. Caldwell, Sr.
*Assistant Examiner*—James J. Groody
*Attorney, Agent, or Firm*—Charles P. Padgett, Jr.

[57] ABSTRACT

A positional display system for visually indicating given geographical locations such as the position of motor vehicles such as police cars and/or the location of the occurrence of an incident warranting police attention. The system includes a display board having a row and column matrix of individual lights and a map of the local geographic area of concern overlaying the matrix so that each light represents a unique map section. Whenever a patrol car transmits its position to a central station or a remote alarm indicates the occurrence of a robbery or the like, information indicative of the row and column address of the given location and at least one instructional command for determining the light status are entered. The entered information is converted into binary numbers indicative of the row and column addresses and the converted binary numbers are temporarily stored. The stored numbers are compared with the output of a scanning counter. The comparator outputs are gated to enable the instructional command for determining the status of the lights to be entered into a memory whenever the entered row and column address is scanned by the counter. The scanning counter is also coupled to a row decoder which sequentially generates the series of individual row scan signals and to a column decoder which sequentially generates a series of column scan signals. These signals are gated with the output of the memory and used to address corresponding rows and columns of the matrix so that when each row and column light is addressed, its illumination status will be determined by the memory output in accordance with the instructional command. If the location of the police cars are entered with an instructional command specifying a steady light condition and the location of an incident is entered with an instructional command specifying a blinking light, the person observing a display board will observe the locations of all patrol cars as steady lights and the location of the incident as a blinking light and will be able to determine which car is closest to the location of the incident for facilitating command and control dispatching decisions and the like.

22 Claims, 12 Drawing Figures

STROBE
X ROW
Z INTENSITY
Y COL
52
ROW DECODE
53
COL. DECODE
51
RAM
56
LOGIC
FROM 57
54
ROW COMP.
55
COL. COMP.
50
ENABLE CKT.
FLAG
CODE 8/0
48
ROW COMP.
49
COL. COMP.
46
AUX. SI/PO
47
ROW/ COL. COUNTER
45
SI/PO
TO 56
57
÷
CODE 4
DATA
CLOCK
DATA
CLOCK

VEHICLE LOCATOR SYSTEM

BACKGROUND OF THE INVENTION

This invention relates to a vehicle locator system for displaying the position of motor vehicles such as police cars operating within a given geographic area. More particularly, the invention relates to a positional display system for indicating the position of a plurality of vehicles such as police cars on a map overlay together with the location of the occurrence of an incident warranting police attention so as to aid a dispatcher in making command and control decisions and the like.

The prior art contains many different types of vehicle location systems nearly all of which are extremely complex and expensive. Many of the systems of the prior art employ a plurality of fixed wayside stations located about the geographical area of concern which aid in automatically determining the position of a vehicle operating within the area. Such systems are quite complex and expensive and require positioning and maintaining the wayside stations thereby greatly increasing the cost and decreasing the reliability of the systems.

The present invention avoids the disadvantages of the prior art and provides a relatively inexpensive, highly reliable display system adaptable for use in large or small applications, to cover either large or small geographic areas, and for use with either a large or a small number of motor vehicles.

SUMMARY OF THE INVENTION

The vehicle locator system of the present invention provides a means for visually indicating a given location such as the position of a motor vehicle such as a police car or the location of the occurrence of an incident warranting police attention to aid in making command and control decisions. The display system includes a display board having a row and column matrix of individual lights and a map of the given area of concern overlaying the matrix so that each of the individual lights represent a unique map section. Means are provided for inputting a sequence of decimal digits of information indicative of the specific row and column address of the given location and at least one command digit for determining the desired status of illumination of the individual light located at the given row and column address on the display board. Means are provided for converting the entered decimal digits of information into their binary equivalents so that the row address is represented by a first binary number and the column address by a second binary number. Means are provided for temporarily storing the binary numbers as are means responsive to the conversion of said command digits for generating a "light on" or "light off" signal.

Scanning means are provided which include a $2^{m+n}$ bit binary up counter having a first set of "m" outputs corresponding to the first "m" bit positions of the counter and a second set of "n" outputs corresponding to the next successive "n" bit positions of the counter. A row comparator has one set of inputs coupled to a first set of outputs of the temporary storage means which output the first binary number and a second set of comparator inputs coupled to the first set of "m" scanning outputs of the counter. A column comparator is provided which has its first set of comparator inputs coupled to a second set of outputs of the temporary storage means which output the second binary number and a second set of comparator inputs coupled to the second set of "n" scanning outputs of the counter. The row comparator outputs a "row equal" signal when equivalency exists between its inputs and the column comparator generates a "column equal" signal at its output when its inputs are equal.

Memory means are provided having scanning inputs coupled to the first and second sets of scanning outputs of the binary up counter for scanning the row and column addresses of the memory. Additionally, the memory means includes a write input coupled to the temporary storage means for presenting the "lights on" or "lights off" signal to the memory and a write enable input responsive to the presence of a "write enable" signal to cause the memory means to write the "light on" or "light off" signal into the memory location then being addressed by the scanning means. The memory means also includes an output for reading out the appropriate "lights on" or "lights off" signal stored in each of the memory locations as they are addressed.

Gating means are provided having inputs coupled to the outputs of the row and column comparator means for generating said "write enable" signal when the "row equal" and "column equal" signals exist simultaneously. A row decoder means is coupled to the first set of "m" outputs of the scanning means for sequentially addressing the individual rows of the matrix and a column decoder means is coupled to the second set of "n" outputs of the scanning means for sequentially addressing the individual columns of the matrix. Logical gating means responsive to the output of the row decoder means, the output of the column decoder means, and the output of the memory means is provided for sequentially addressing each of the lights in the matrix and for selectively energizing a given light in the row and column matrix when the command digit entered with the given row and column coordinates so dictates, thereby visually displaying the location of the motor vehicle and/or incident on the display board for command and control purposes.

The vehicle location system of the present invention finds use in many different types of applications. For example, in the preferred embodiment of the present invention, the system is used to visually display the location of motor vehicles such as police cars, fire vehicles, ambulances, etc. with respect to a given geographical area. Similarly, the system could be used to show the position of a fleet of vehicles such as taxi cabs, industrial vehicles, busses or the like.

In the preferred embodiment of the present invention, an operator located at the central station at which the display board is located, receives a telephone call, burglar alarm signal or the like which indicates the location of an occurrence warranting police attention. He then refers to an index, utilizes a punched card or the like to enter the location of the occurrence of the incident and a control digit, such as would command a blinking light, into the system. Similarly, the individual police cars on patrol would periodically or upon request radio their identification, their positional location, preferably in terms of the row and column coordinates to be entered, and possibly additional status information. The operator would then enter the row and column coordinates and an appropriate command digit such as would command a steady "light on" condition into the system as by means of a ten-key keyboard or the like.

The present system also contemplates the use of a punched card and a card reader to enter the row and column coordinates of a given location into the system or a decoder means which translates audio information received from an intercom, a tone generator such as a touch tone pad from a telephone, or audio information transmitted directly over the police radio. Regardless of the means of entry, information indicative of the row and column address of given locations are entered into the system together with command digits indicating the status of illumination of the lights identifying that position.

The system may include indicator means for visually displaying the individual digits as they are entered into the system as an error check so that the operator entering the information can be sure that the proper information has been entered prior to its being displayed.

Furthermore, the system may include additional duplicate components responsive to still other command digits not only insuring that the given light at the entered location is illuminated or not illuminated but for blinking a light corresponding to the given location, such as may be desired to differentiate the position of the occurrence of an incident from the steady lights indicating the position of the patrol car. This would enable the operator observing the display board to determine which of the patrol cars is closest to the location of the incident to enable him to make more efficient and effective command and control dispatching decisions.

Other advantages and meritorious features of the present invention will be more fully understood from the following description of the drawings and the preferred embodiments, the appended claims and the drawings which are briefly described hereinbelow.

DESCRIPTION OF THE PREFERRED EMBODIMENT

Figure 1:
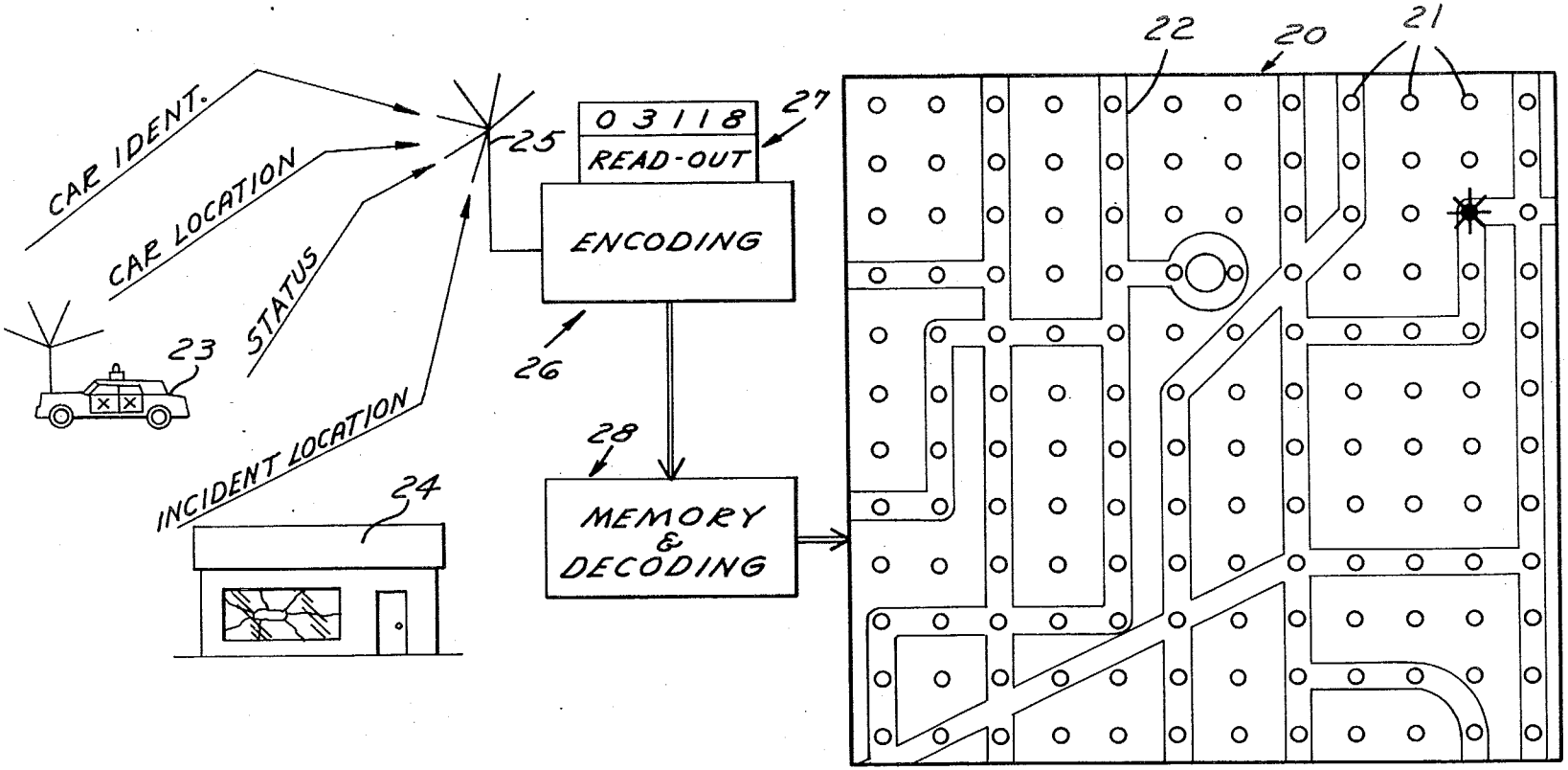
FIG. 1 is a block diagram of the vehicle location system of the present invention.

The borad overall concept of the vehicle locator system of the present invention will be generally described with reference to FIG. 1. The vehicle locator system of the present invention includes a display board 20 including a row and column matrix of individual lights 21 and a map 22 overlaying the matrix so that each of the individual lights 21 represents a unique locational area or geographical section of the map 22.

In the preferred embodiment of the present invention, the display board 20 is located at a central station, such as a police headquarters, fire station or the like. A plurality of emergency vehicles 23 such as police cars, fire equipment, or the like, would be free to travel throughout the geographic area of concern which is represented by the map overlay 22 and could periodically or upon request send back information representative at least of the identification of the car 23 together with its row and column coordinate position with respect to the map overlay 22, and/or its status or the like. This information could be sent back by means of the car radio or some similar means to the central headquarters for processing.

Similarly, a plurality of buildings or physical locations 24 which are located about the geographic area of concern could transmit information indicative of the occurrence of an incident warranting police attention, such as a burglary, fire alarm or the like back to headquarters by means of a telephone call, burglar or fire alarm system, or the like. This information is indicated as being received at antenna 25 and supplied to the encoding block 26 of FIG. 1.

The priority encoding station 26 includes a read-out or indicator portion 27 for visually displaying the decimal digits of data as they are entered into the encoding station 26 for error checking purposes and the like. The encoding station 26 includes input and temporary storage circuitry as described hereinafter. The encoding station 26 is coupled to block 28 which represents the scanning, memory and decoding circuitry to be described hereinafter.

Figure 2:
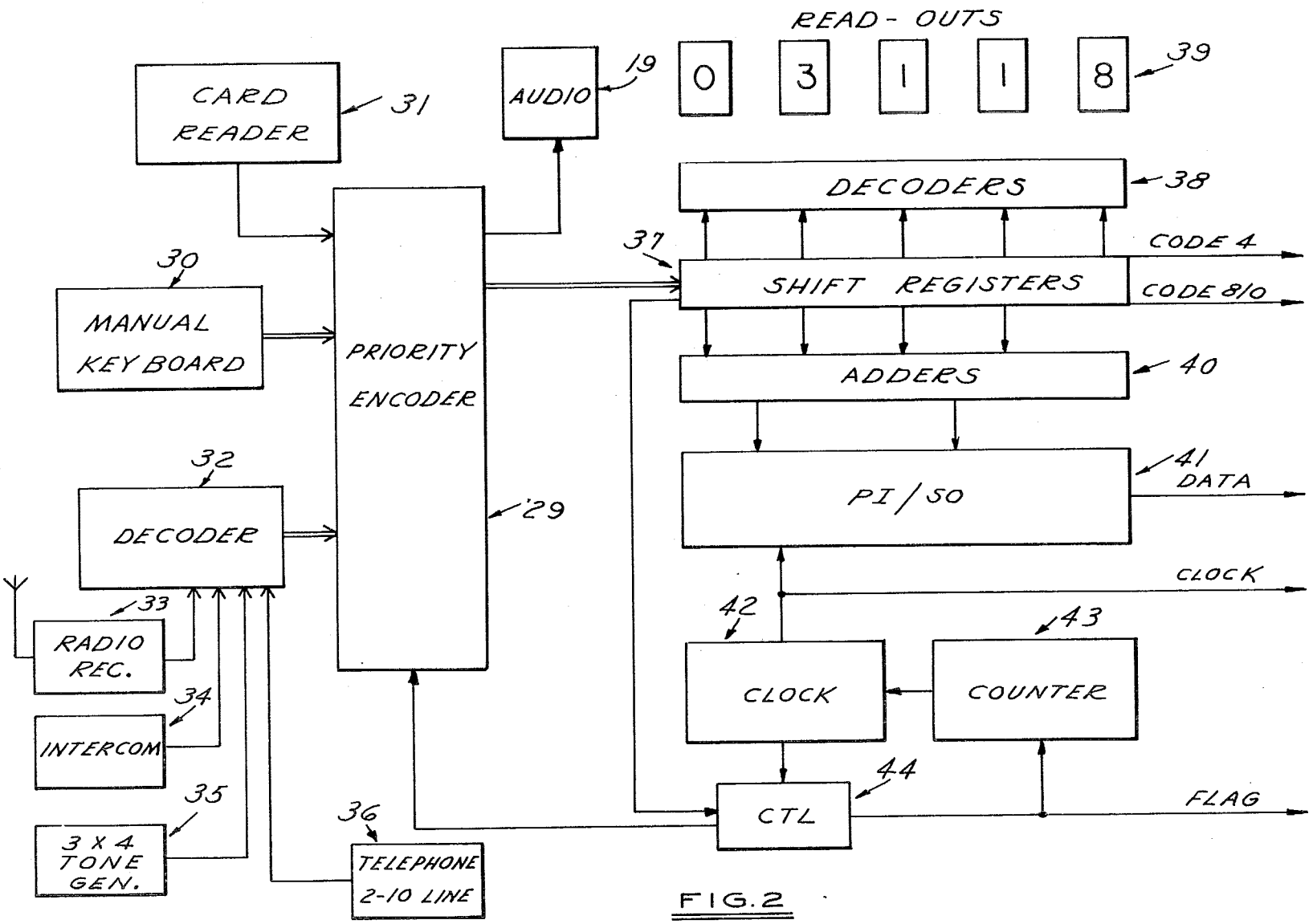
FIG. 2 is a block diagram of the entry and temporary storage portions of the vehicle location system of the present invention.

FIG. 2 is the block diagram generally representing the encoding station 26 of FIG. 1. The encoding station includes a priority encoder circuit represented by block 29. The priority encoder circuit receives its input from one or all of the sources indicated, as desired. The input to the priority encoder circuit 29 may be from a manual keyboard as indicated by block 30 and as described in greater detail with respect to FIG. 8. Similarly, the input to the priority encoder circuit 29 could be taken from the output of a card reader 31 which could read either magnetic, optical or punched code cards or tapes, as conventionally known.

Similarly, the inputs to the priority encoder circuit 29 could be taken from the output of a conventional acoustical decoder 32. The decoder 32 is capable of receiving audio tone inputs and converting these inputs into electrical signals representative of decimal digits of information to be entered into the priority encoder circuit 29. For example, the input to the acoustical tone decoder 32 could be taken directly from a radio receiver 33 which receives radio signals directly from the police car 23 and supplies audio tone signals to the input of the decoder 32. Similarly, the input to the tone decoder 32 could be taken from conventional intercom circuitry 34; from the output of a conventional three by four tone generator circuit 35, or from the output of a standard telephone two to ten line circuit 36.

The priority decoder circuitry 29 may be capable of sounding an audio signal as by audio circuit 19 either when information has begun to be entered into the encoder circuitry 29 or when entry is complete, or both. Alternately, the audio circuit 19 could be used to sound an alarm when an officer-in-distress call or the like is received.

As each decimal digit of information is entered into the priority encoder circuitry of block 29, a shift pulse is generated and a binary number representative of the entered decimal digit of information (actually a BCD digit) is entered into the shift registers of block 37. The contents of the shift registers are then shifted to await the entry of the next decimal digit of information to be entered. Appropriate output stages of the shift registers of block 37 may be coupled so that the first output generates a "Code Four" signal whenever the decimal digit "4" is entered after the row and column positional coordinates to indicate that a blinking light is required. Similarly, the appropriate shift register output may be tapped to generate a "Code Eight/Zero" output to indicate a steady "light on" or steady "light off" condition depending on whether the decimal digit "8" or the decimal digit "0" was entered after the entry of the row and column coordinates. The shift register outputs may be also coupled to the inputs of the decoder circuitry 38 and the output of the decoders 38 are coupled to indicators such as display tubes 39 which sequentially show the decimal digits of information as they are entered into the priority encoder circuitry of block 29 for error checking purposes or the like.

The outputs from the stages of the shift registers 37 which ultimately store the binary numbers representing the row and column coordinates of the entered location are supplied to the inputs of adder circuitry 40 and combine to generate a first binary number representing the row coordinate and a second binary number representing the column coordinate of the entered location. The outputs of the adder circuitry 40 supply these two binary numbers in parallel to a parallel-in/serial-out register 41 so that a single sequence of binary bits representing the first and second binary numbers and hence the row and column coordinates are stored therein. A data output is taken from the parallel-in/serial-out register 41 for supplying the sequence of binary bits to the circuitry of block 28 for further processing as hereinafter described.

A first clock 42 is connected to the input of a counter 43 and a control circuit 44 couples the clock 42 and counter 43 to the shift registers of block 37. When the last decimal digit of information has been entered into the priority encoder circuit of block 29, the control circuit of block 44 prevents the entry of any further decimal digits of information into the circuitry of block 29 and enables the clock 42 to generate clock pulses. The counter 43 counts a number of clock pulses equal to the number of sequential bits in the sequence of binary bits stored in the parallel-in/serial-out register 41 and as soon as this number of binary bits has been counted, the clock 42 is turned off. The counted clock pulses are used to serially step the sequence of binary bits out of the parallel-in/serial-out register 41 for further processing and both the clock pulses and a flag signal indicating that the last clock pulse has been counted are supplied to the circuitry of block 28 for further processing.

Figure 3:
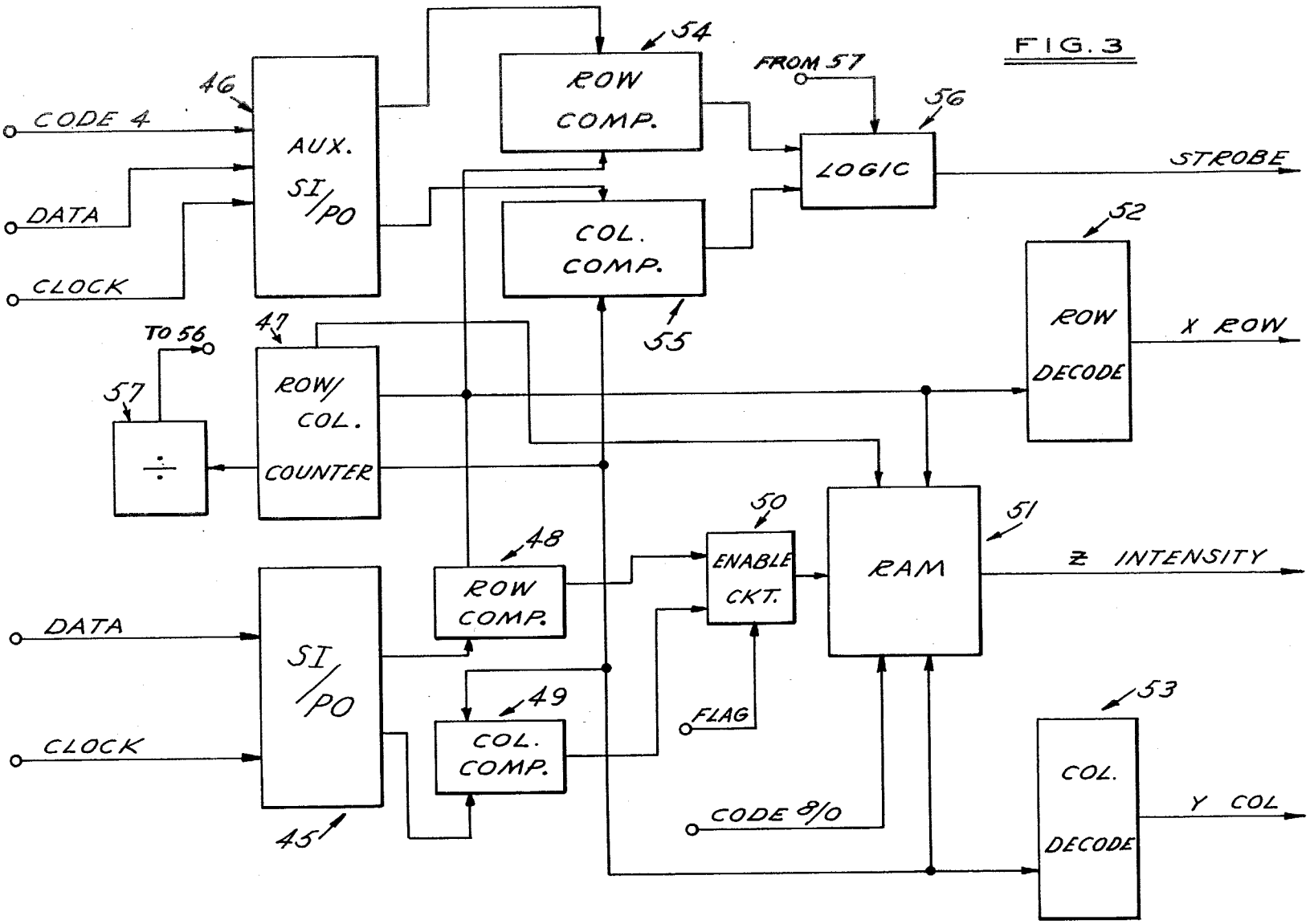
FIG. 3 is a block diagram of the scanning, comparing, memory and decoding section of the vehicle location system of the present invention.

FIG. 3 generally represents the scanning circuitry, comparing circuitry, memory circuitry and decoding circuitry of block 28 of FIG. 1 and receives the input from the correspondingly identified outputs of the block diagram of FIG. 2.

The clock pulses and the serial sequence of binary bits outputted from the parallel-in/serial-out register 41 of FIG. 2 are supplied to a first serial-in/parallel-out register 45 and simultaneously to a second auxiliary serial-in/parallel-out register 46. The auxiliary register 46 is only enabled to receive the data and clock pulses when the Code Four signal is outputted in the shift register 37 of FIG. 2 indicating that the row and column location entered is to be displayed by a blinking light so as to indicate the location of an occurrence of an incident warranting police attention or the like.

The station of block 28 also includes a binary up counter 47 and a master clock associated therewith so that a first set of counter outputs can be used as a source of row scan pulses while a second set of counter outputs can be used as a source of column scan pulses.

A first row comparator 48 has one set of inputs coupled to the outputs of the serial-in/parallel-out register 45 for receiving the first binary number indicative of the row coordinate while the other set of comparator inputs is connected to the row scan outputs of the counter 47. Similarly, a first column comparator 49 has its first set of inputs coupled to the second set of outputs of the serial-in/parallel-out register 45 for supplying the second binary number indicative of the column coordinate thereto and a second set of inputs coupled to the column scan outputs of the counter 47. The comparator 48 generates a "row equal" signal whenever its inputs are equal while the column comparator 49 outputs a "column equal" signal whenever its inputs are equal. The outputs of the row comparator 48 and the column comparator 49 are supplied to an enable circuit or gate 50 whose other input is taken from the flag output of FIG. 2 so that whenever the last of the counted clock pulses of FIG. 2 has been generated indicating that the last of the data has been entered into the register 45, and the "row equal" and "column equal" signals occur simultaneously, the write command port of a one bit random access memory 51 is enabled.

The memory 51 has one set of address lines coupled to the row scan outputs of the counter 47 and a second set of address lines coupled to the column scan output of the counter 47 so that the individual row and column memory locations thereof are sequentially scanned thereby. The data input of the memory 51 is taken from the Code Eight/Zero output of the circuit of FIG. 2 so that as the individual memory locations are scanned, the appropriate high or low signal indicated by the Code Eight/Zero command will be entered into the correct memory location for later use.

FIG. 3 also shows a row decoder 52 having its inputs coupled to the row scan outputs of the counter 47 for generating a sequence of individual row outputs for addressing the individual rows of the matrix. Similarly, a column decoder circuit 53 is included which has its inputs coupled to the column scan outputs of the counter 47 for outputting a plurality of column addressing signals for each of the individual columns of the matrix.

A second row comparator 54 has a first set of inputs coupled to a first set of outputs of the auxiliary serial-in/parallel-out register 46 for receiving the first binary number representative of the row coordinates therefrom and a second set of inputs coupled to the row scan outputs of the counter 47. Similarly, a second column comparator 55 has its first set of inputs coupled to the second set of outputs from the auxiliary serial-in/parallel-out register 46 for receiving the second binary number indicative of the column coordinate therefrom and its second set of inputs coupled to the column scan outputs of the counter 47. The second row comparator 54 generates a "row equal" signal when its inputs are equal and the second column comparator generates a "column equal" signal when its inputs are equal. The outputs of the comparators 54, 55 are coupled to the inputs of a logical gating circuit 56 which has another of its inputs coupled to the output of a frequency divider circuit 57 whose input is taken from the counter 47 for supplying a relatively slow clock pulse thereto. The output of the logical gating circuit of block 56 will supply a strobe pulse whenever a Code Four signal has been generated. Alternatively, the output of the logic circuit 56 could be used to generate a write enable signal to enable a second auxiliary random access memory to store the Code Four signal in the appropriately scanned memory location, if desired.

Figure 4:
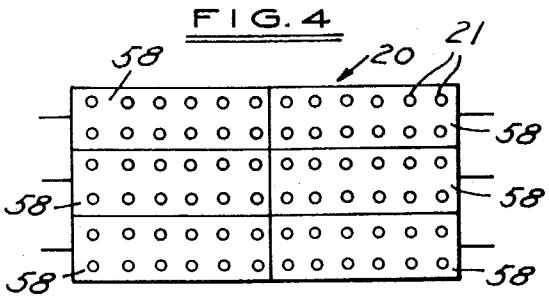
FIG. 4 is a block diagram broadly illustrating the display board of the present invention.

FIG. 4 represents broadly the matrix of individual lights 21 of the display board 20 divided into six identical matrix panels 58.

Figure 6:
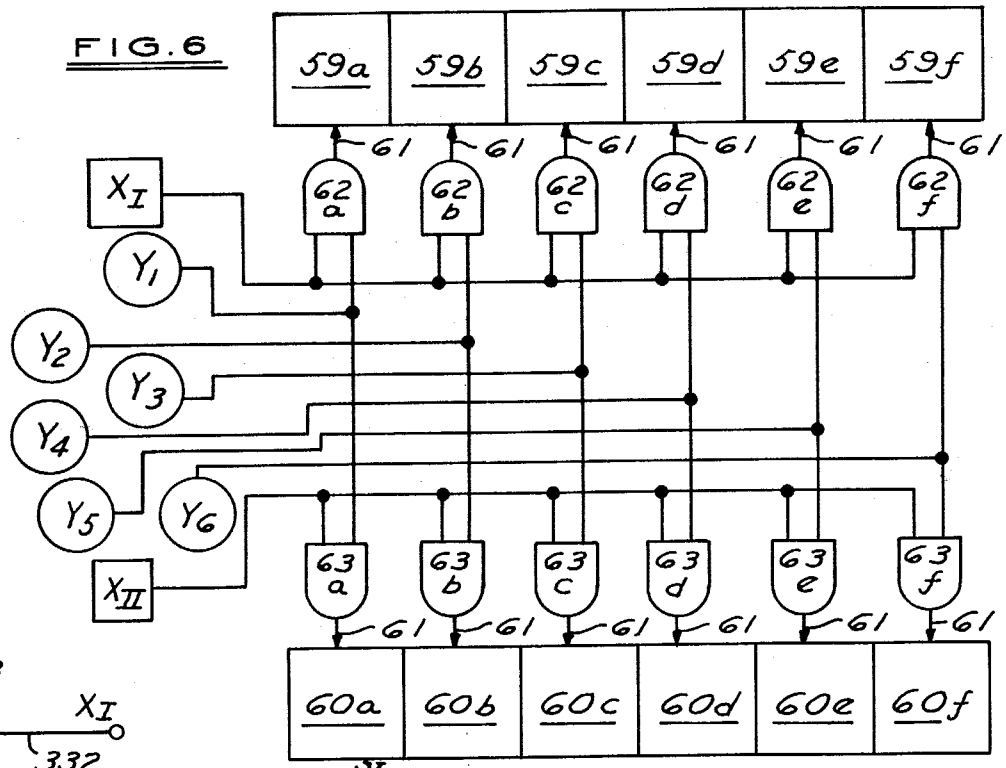
FIG. 6 illustrates one section of a remaining portion of the gating means used to address the individual row and column addresses of the display board of the present invention.

FIG. 6 shows a schematic illustration of one of the matrix panels 58 of the present invention. Each matrix panel 58 may include, for example, two rows each having six columns of individual lights so that there is a first row of individual lights 59*a* through 59*f* and a second row of individual lights 60*a* through 60*f*. Each of the individual lights includes the detailed circuitry shown in FIG. 7 and each has a light input 61. A first row of logical AND gates 62*a* through 62*f* have their outputs coupled via the light input 61 to the individual lights 59*a* through 59*f* respectively. Similarly, a second row of logical AND gates 63*a* through 63*f* have their outputs coupled to the inputs 61 of the individual lights 60*a* through 60*f* respectively.

Each of the AND gates 62*a* through 62*f* and 63*a* through 63*f* has two inputs. The first input of each of the logical AND gates 62*a* through 62*f* is coupled to a gated row scan signal $X_I$ and the first input to each of the AND gates 63*a* through 63*f* is connected to a second gated row scan signal $X_{II}$. The second input to the AND gates 62*a* and 63*a* is taken from the first decoded column scan output $Y_1$ of the column decoder 53; while the second input of the AND gates 62*b* and 63*b* is taken from the second decoded column scan output of $Y_2$; the second input to the AND gates 62*c* and 63*c* is taken from the third decoded column scan output $Y_3$; the second input to the fourth column of AND gates 62*d* and 63*d* is taken from the fourth decoded column scan output $Y_4$; the second input to the next column of AND gates 62*e* and 63*e* is taken from the fifth decoded column scan output $Y_5$; and the second inputs to the sixth column of AND gates 62*f* and 63*f* is taken from the sixth decoded column scan output $Y_6$ of the column decoder 53. Therefore, whenever both the gated row scan input and the decoded column scan inputs are both high, the individual light 21 of the matrix display board 20 which is connected by a light input 61 thereto, is turned on.

Figure 7:
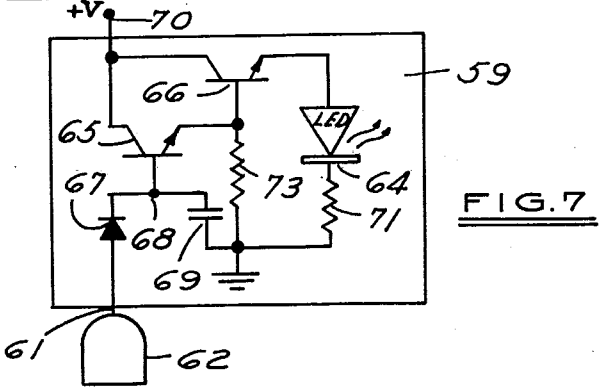
FIG. 7 illustrates the specific circuitry associated with each individual light of the matrix of the display board of the present invention.

FIG. 7 illustrates a typical individual light 21 such as would be used in the matrix panel 58 of FIG. 6. Each of the individual lights, such as that represented by block 59*a* of FIG. 6, includes a light emitting diode 64 and a darlington amplifier pair represented by transistors 65, 66. The output of the AND gate 62*a* is connected to the light input 61. The input 61 is connected to the anode of a diode 67 whose cathode is connected to the base input node 68 of the darlington amplifiers 65,66. The base input node 68 is also connected to ground through a capacitor 69. The collectors of the transistors 65 and 66 are commonly coupled to a source of electrical potentials 70 and the emitter of the output transistor 66 is connected to the anode of the light emitting diode 64. The cathode of the light emitting diode 64 is coupled to ground through a resistor 71 and the collector of the first input darlington transistor 65 is connected to the base node 72 of the second darlington transistor 66 while the base node 62 is connected to ground through a resistor 73.

The light emitting diode 64 of the circuit of FIG. 7 is current sensitive rather than voltage sensitive and the use of the darlington amplifier of transistor 65, 66 establishes that there is no need for peripheral drivers and prevents the base current from inadvertently switching the light emitting diode off. The input diode 67 and capacitor 69 serves to smooth out the operation of the light emitting diode 64 to prevent flickering from interfering with the use of the light 59*a* in closed circuit television applications and the like.

Figure 8:
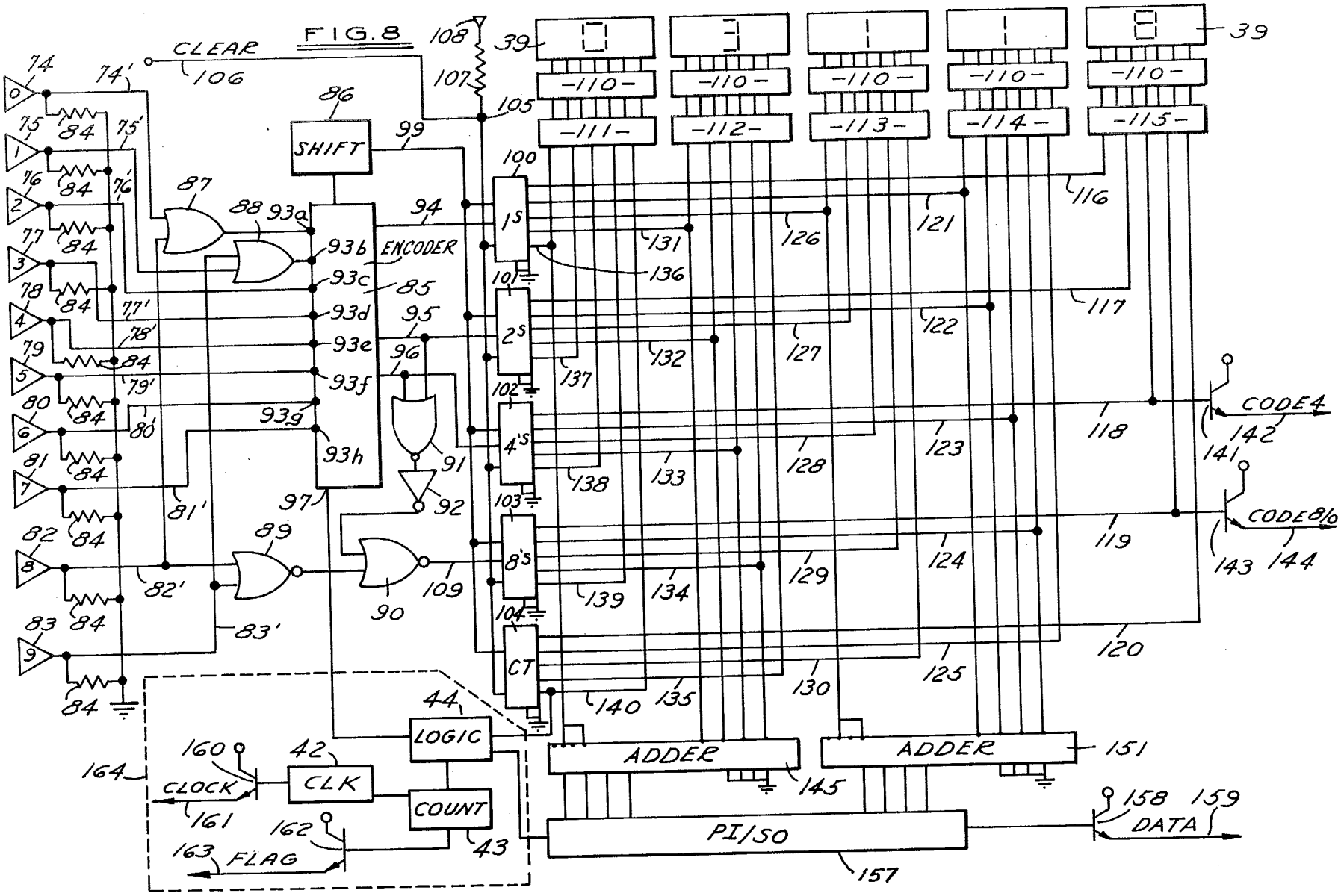
FIG. 8 is a detailed systematic diagram of the input and temporary storage portion illustrated by the block diagram of FIG. 2.

FIG. 8 illustrates a schematic diagram of the encoder station of FIG. 2 in greater detail. The manual keyboard 30 of FIG. 2 is represented as a ten-key decimal keyboard having ten keys 74–83 corresponding to the decimal digits zero through nine respectively. Each of the keys 74–83 has its key output coupled through a resistor 84 to ground and through a lead 74' through 83' respectively to serve as inputs to the priority encoder circuitry of block 29. The priority encoder circuitry of block 29 of FIG. 2 includes a one-of-eight priority encoder 85 such as a standard CD-4532; the shift circuitry of block 86; logical OR gates 87 and 88; logical NOR gates 89, 90 and 91; and an inverter 92.

The one-of-eight priority encoder 85 has eight inputs 93*a* through seven respectively. The encoder 85 is provided with conventional automatic key roll-over with priority such that if two keys are depressed simultaneously, the lowest valued key will always prevail. The priority encoder 85 has a units output 94, a 2's output 95, a 4's output 96 corresponding to the first, second and third bit positions of the binary number into which the decimal input is converted by the internal circuitry thereof. Furthermore, the priority encoder 85 has a lock out input 97 adapted to receive a lock out pulse for disabling the priority encoder 85 from receiving any further inputs until cleared and a "in use" output 98 which generates a high signal whenever a decimal digit of data is being received at its inputs. The shift circuitry of block 86 receives the "in use" signal from output 98, as hereinafter described, and generates a shift pulse at the output 99 upon the completion of entering each of the decimal digits of information into the priority encoder 85 for conversion into its binary equivalent at the outputs 94, 95 and 96.

The output 74' from the zero key 74 is connected to one input of the OR gate 87 whose other input is connected to the output 82' of the eight key 82 so that the output of OR gate 87 goes high when either the zero key 74 or the eight key 82 is depressed. The output of OR gate 87 is coupled to the first or zero input 93*a* of the priority encoder 85. Similarly, one input of OR gate 88 is connected to the output 75' of the one key 75 while the other input of the OR gate 88 is connected to the output 83' of the nine key 83 so that its output goes high when either the one or the nine key is depressed. The output of OR gate 88 is connected to the one input 93*b* of the priority encoder 85.

The output 76' of the two key 76 is directly connected to the input 93*c* of the priority encoder 85 and the outputs 77' through 81' of the keys 77 through 81 respectively are directly connected to the inputs 93*d* through 93*h* respectively for entering information directly therein. The output 82' of the eight key 82 is connected to one input of a NOR gate 89 whose other input is connected to the output 83' of the nine key 83. The output of NOR gate 89 is connected directly to one input of a second NOR gate 90 whose other input is connected to the output of an inverter 92. The input of the inverter 92 is connected to the output of a third NOR gate 91 having one of its inputs connected to the 2's output 95 of the priority encoder 85 and its other input connected to the 4's output 96. The NOR gates 89, 90 and 91 and the inverter 92 insure that the eight key 82 and nine key 93 cannot be used to enter information into the shift registers 37 unless the 2's output 95 and 4's output 96 from the priority encoder 85 are both low.

The shift registers of block 37 of FIG. 2 include a 1's shift register 100, a 2's shift register 101, a 4's shift register 102, an 8's shift register 103, and a fifth shift register 104 which is used as a counting circuit. Each of the shift registers 100–104 has a shift input connected to the output 99 of the shift circuitry of block 86 and each has a clear input directly coupled to a clear input node 105. Node 105 is connected via lead 106 to a source of clear signals and through a resistor 107 to a source of potential 108. The data input to the 1's shift register 100 is taken directly from the units output 94 of the priority encoder 85. The data input of the 2's shift register 101 is connected directly to the 2's output 95 of the priority encoder 95 and the data input of the 4's shift register 102 is connected directly to the 4's output 96 of the priority encoder 85. The data input to the 8's shift register 103 is connected directly to the output of NOR gate 90 via lead 109. The data input to the fifth shift register 104 is connected directly to a source of potential so that as the shift register 104 receives shift pulses from the output 99, it will store a high in each in each successive stage of the shift register and then shift it to await the receipt of the next shift pulse thereby acting as a counter.

In operation, let us assume that the geographical location of a police car 23 is to be entered into the priority encoder of block 29. Assume that the police car is currently located at a map location represented by a light 21 of the matrix of the display board 20 defined by the intersection of the third row and the eleventh column. Let us further assume that the position of the police car 23 is to be indicated by a steady "on light" condition. Therefore, five decimal digits of information will be entered to define the row and column coordinates and the instructional command required to light a steady light at the third row and eleventh column of the matrix lights 21. The digits "0 3 1 1 8" are entered by sequentially pressing the correspondingly numbered keys 74, 77, 75, 75, 82 respectively. When the zero key 74 is depressed, the output of OR gate 87 goes high and zeroes are present on the outputs 94, 95, 96 and 109 since the binary equivalent of a decimal zero is the binary number 0000. Therefore, a zero is entered in to the first stage of each of the shift registers 100, 101, 102 and 103. As soon as the decimal digit zero is entered and converted into binary form, a shift pulse will be generated by the circuit of block 86. The shift pulse is outputted on lead 99 and as soon as the zeroes are inputted into the first stage of the shift registers 100, 101, 102 and 103, the contents are shifted to the next higher stage so that the lower stage awaits the input of the next decimal to binary converted number.

Since the second decimal digit of information to be entered is the decimal number three, the three key 77 will be depressed causing a high to be presented at the input 93*d* to the priority encoder 85. The priority encoder 85 converts the decimal number 3 into its binary equivalent so that a one appears at the output 94 and is inputted into the first stage of the 1's shift register 100 and a one appears at the output 95 to be entered into the first stage of the 2's shift register 101. A zero is entered into the 4's shift register from the output 96 and a zero is entered into the 8's shift register by the lead 109 from the output of NOR gate 90. After the first decimal digit zero was entered into the priority encoder 85, a high was entered into the first stage of the counter 104 so that the arrival of the first shift pulse from the output 99 transferred this high to the next higher stage.

Now that the decimal digit three has been entered, a second shift pulse will be generated at the output 99 causing the contents of each of the shift register stages to be shifted to the next higher stage so that the lowest stage can await the input of the next converted number. Again, a high is inputted into the lower stage of shift register 104 and then its contents shifted. Similarly, the decimal digit one is entered followed by the generation of the third shift pulse and then the decimal digit one followed by the generation of the fourth shift pulse.

Finally, the decimal digit eight which is an instructional command indicating that the light defined by the previously entered row and column positional coordinates 0 3 1 1 is to be illuminated in a steady on condition. The digit "8" is entered by depressing the eight key 82 causing a high to appear at the output of OR gate 87 and hence, at the first input 93*a* of the priority encoder 85. This causes the 1's output 94 to go high and presents a high into the lower stage of the 1's shift register 100. Simultaneously, the depression of the key 82 caused the output of NOR gate 89 to go low and since lows are present on both the 2's output 95 and the 4's output 96 of the priority encoder 85, the output of NOR gate 91 is high therefore the output of inverter 92 is low. With both inputs of NOR gate 90 low, its output supplied via lead 109 to the data input of the eight shift register 93 is high. Zeroes are inputted to the lowest stage of the 2's shift register 101, the 4's shift register 102 and again a high is inputted into the counter shift register 104. The fifth shift pulse is supplied at output 99 and causes the entered data to shift to the next higher stage. The first high entered into the counter register 104 has now been shifted to the fifth stage and the output of the fifth stage is tapped and supplied to a control logic circuit 44 having one output which supplies a signal to the lock-out input 97 of the priority encoder means to prevent the entry of further decimal digits of data until the system has been cleared. At this point, the five stages of the shift registers 100 through 103 contain the binary equivalent of the five decimal digits of data entered into the priority encoder circuitry of block 29 of FIG. 2.

The encoding station 26 may also include a plurality of conventional seven segment indicator tubes 39. Driver circuits or readouts 110 supply current to the selected segments of the indicator tubes 39 so that the appropriate decimal digit is displayed thereon, as conventionally known. Each readout 110 receives its inputs from the seven outputs of a conventional four-to-seven line decoder 111, 112, 113, 114 and 115. Each of the line decoders 111 through 115 has its seven outputs coupled to the readouts 110; one set of inputs directly coupled to a source of potential; and each includes a 1's input, 2's input, 4's input, 4's input, and an enable input.

The output of the first stage of each of the shift registers 100–104 is coupled to the 1's , 2's, 4's, 8's, and enable inputs of the right most line decoder 115 via leads 116 through 120 respectively. Similarly, the second output stage of each of the shift registers 100 through 104 are coupled to the 1's, 2's, 4's, 8's and enable input of the line decoder 114 via leads 121 through 125 respectively. Again, the output of the third stage of each of the shift registers 100 through 104 are coupled to the corresponding 1's, 2's, 4's, 8's and enable inputs of the third line decoder 113 via leads 126 through 130 respectively. Yet again, the output of the fourth stage of each of the shift registers 100 through 104 are coupled to the 1's, 2's, 4's, 8's and enable inputs of the fourth line decoder 112 via leads 131 through 135 respectively. Lastly, the output of the fifth and final stage of each of the shift registers 100 through 104 are coupled to the 1's, 2's, 4's, 8's and enable input of the fifth and last line decoder 111 via leads 136 through 140, respectively.

Since the first or lowest ordered stage of each of the shift registers 100 through 104 ultimately stores the binary number representing the last decimal digit of information to be entered into the system and since the last digit represents an instructional command which specifies the status of illumination of the light 21 located at the row and column coordinates entered, the lead 118 from the first lowest ordered stage of the 4's shift register 102 may be connected to the base of a driver transistor 141 whose emitter is coupled to a Code 4 output 142 for supplying a high signal whenever the decimal digit four has been entered as the instructional command into the priority encoder 85 to indicate that the light corresponding to the row and column coordinates previously entered is to be continually blinked on and off.

Similarly, the lead 119 which is taken from the first or lowest ordered stage output of the 8's shift register 103 can be used to decode the Code 8 or Code Zero instructional command. A lead 119 is connected to the base of the second driver transistor 143 whose emitter serves as the Code 8/0 output 144. If the decimal digit 8 was entered as the fifth or instructional command digit into the priority encoder 85, then a high will be stored in the first stage of the shift register 103, causing the driver transistor 143 to drive a high at its output 144. Similarly, if a zero or something other than an eight were entered as the last command digit, the signal stored in the first stage of the 8's shift register 103 will be low causing a low to appear at the Code zero output 144. The presence of a high at the output 144 indicates that the light 21 located at the row and column coordinates entered is to be placed in a steady on state of illumination whereas a low indicates that the light is to be continually off.

In operation, as sonn as the first decimal digit, in the present example, zero, has been entered into the priority encoder circuit, zeroes will be present in the first stage of each of the shift registers 100 through 103 and a high will be present in the first stage of register 104. The high from the first stage output of register 104 will be supplied via lead 120 to the enable input of the line decoder 115 causing the first indicator 39 to display the decimal digit zero. The shift pulse is generated at the output 99 causing the zeroes stored in the first stages to be shifted to the second stage so that the first stage can again await the entry of the next digit to be entered.

The next decimal digit to be entered is the digit three. As soon as it is entered, both the line decoder 114 and the line decoder 115 will be enabled so that the decimal digit 0 will be displayed on the indicator tube 39 corresponding to the line decoder 114 while the decimal digit 3 will be displayed on the indicator tube 39 corresponding to the line decoder 115. Similarly, as each decimal digit is entered, the previously displayed digits will be presented on the next left indicator tubes and the most recently entered digit on the indicator tube 39 corresponding to the line decoder 15 until the fifth and last digit has been entered. At this time, all of the line decoders 111 through 115 are enabled and all five of the entered decimal digits 0, 3, 1, 1, 8 are displayed on the indicators 39 as indicated in FIG. 8. In the present example, a fifth or instructional command was the digit eight indicating that the status of the address light is to maintain a steady on condition therefore, the code eight output 144 will remain high. As soon as the last shift pulse is counted by the shift register 104, the arrival of the high at the last stage will be gated through the logic circuitry of block 44 to lock out the entry of further digits into the encoder 85.

A first full adder 145 is used to convert the two binary coded decimal digits defining the row coordinate into a single true binary number representing the row coordinate of the given location entered into the system. A first set of adder inputs has the 2's and 8's input commonly coupled together and connected via lead 146 to the output of the last stage of the 1's shift register 100 via lead 136. Therefore, when a one has been entered into the last stage of the 1's shift register 100, it means that a ten will be inputted into the adder 145. The second set of inputs of the adder 145 has the 1's input coupled to the 4th output stage of the 1's shift register 100 via lead 147 and lead 131; the 2's input connected to the output of the fourth stage of the 2's shift register 101 via lead 148 and 132; the 4's input connected to the fourth stage output of the 4's shift register 102 via lead 133 and 149 and the 8's input connected to the output of the fourth stage of the 8's shift register 103 via leads 134 and 150. Therefore, whenever the two decimal digits representing the row coordinate or address are greater than 10, the adder 145 recevies a tne at the first set of adder inputs and the units entry at the second set of inputs and adds them together to supply a binary number representative thereof at the adder outputs and when the number is less than ten, such as in the present example, the first set of inputs receives a zero and the second set of inputs merely transfers the binary equivalent to the adder outputs.

A second full adder 151 has a first set of inputs with the 2's and 8's input coupled together and connected via a lead 152 to the output of the third stage of the 1's shift register 100 via lead 126 for supplying a ten to the adder 151 whenever a one is entered in the ten place of the two-digit BCD number representing the column coordinate or address entered into the system. Similarly, the 1's, 2's, 4's and 8's input of the second set of inputs of the adder 151 are connected to the output of the second stage of the shift registers 100, 101, 102 and 103 respectively via respective leads 121, 153; 122, 154; 123, 155; and 124, 156. The parallel outputs of the second adder 151 will, therefore, output a single four bit binary number representing the column coordinate of the entered location.

The circuit of FIG. 8 also includes a parallel-in/serial-out shift register 157 which includes a plurality of serial storage positions for receiving the binary number representing the row address from the parallel outputs of the first adder 145 and the binary number representing the column address from the parallel outputs of the second adder 151 so that the two numbers are stored sequentially in a serial manner one after the other within the parallel-in/serial-out shift register 157. The output of the parallel-inserial-out shift register is connected to the base of a third drive transistor 158 whose emitter serves as the data output 159 for shifting the sequence of binary numbers stored in the register 157 out of the register 157 in a step-by-step serial fashion.

The parallel-inserial-out shift register 157 also has input coupled to the output of the counter of block 43 which in turn is coupled to the output of the clock of block 42. Clock pulses are outputted to a fourth drive transistor 160 whose emitter serves as an output 161 of clock pulses. The counter of block 43 has an output connected to the base of a fifth drive transistor 162 whose emitter serves as the output of a flag signal 163. The specific circuitry of blocks 42, 43, and 44 will be described hereinafter with regard to FIG. 9, but the operation is as follows.

When the output on lead 140 from the fifth and last stage of the counting shift register 140 goes high indicating that the last decimal digit of data has been entered in the encoder 85, the logic of block 44 transmits a signal to the counter 43 and clock 42 causing the clock 42 to generate clock pulses at a predetermined frequency. The counter of block 43 will count a predetermined number of clock pulses equal to the exact number of binary bits stored in the sequence of two binary numbers stored in the parallel-inserial-out shift register 157 from the parallel outputs of the adders 145 and 151. When exactly that predetermined number of clock pulses has been counted by the counter of block 43, the clock of block 42 will be turned off and a flag signal will be generated at the output 163.

The clock pulses counted by the counter 43 are transmitted via clock output 161 for further use and are simultaneously used to serially step the binary bits out of the register 157 in a step-by-step serial fashion to output the stored binary numbers at the data output 159. The structure and operation of the circuits of blocks 42, 43 and 44, which are indicated generally as being enclosed within the dotted block 164 of FIG. 8 will be described in greater detail with reference to the circuit of FIG. 9.

Figure 9:
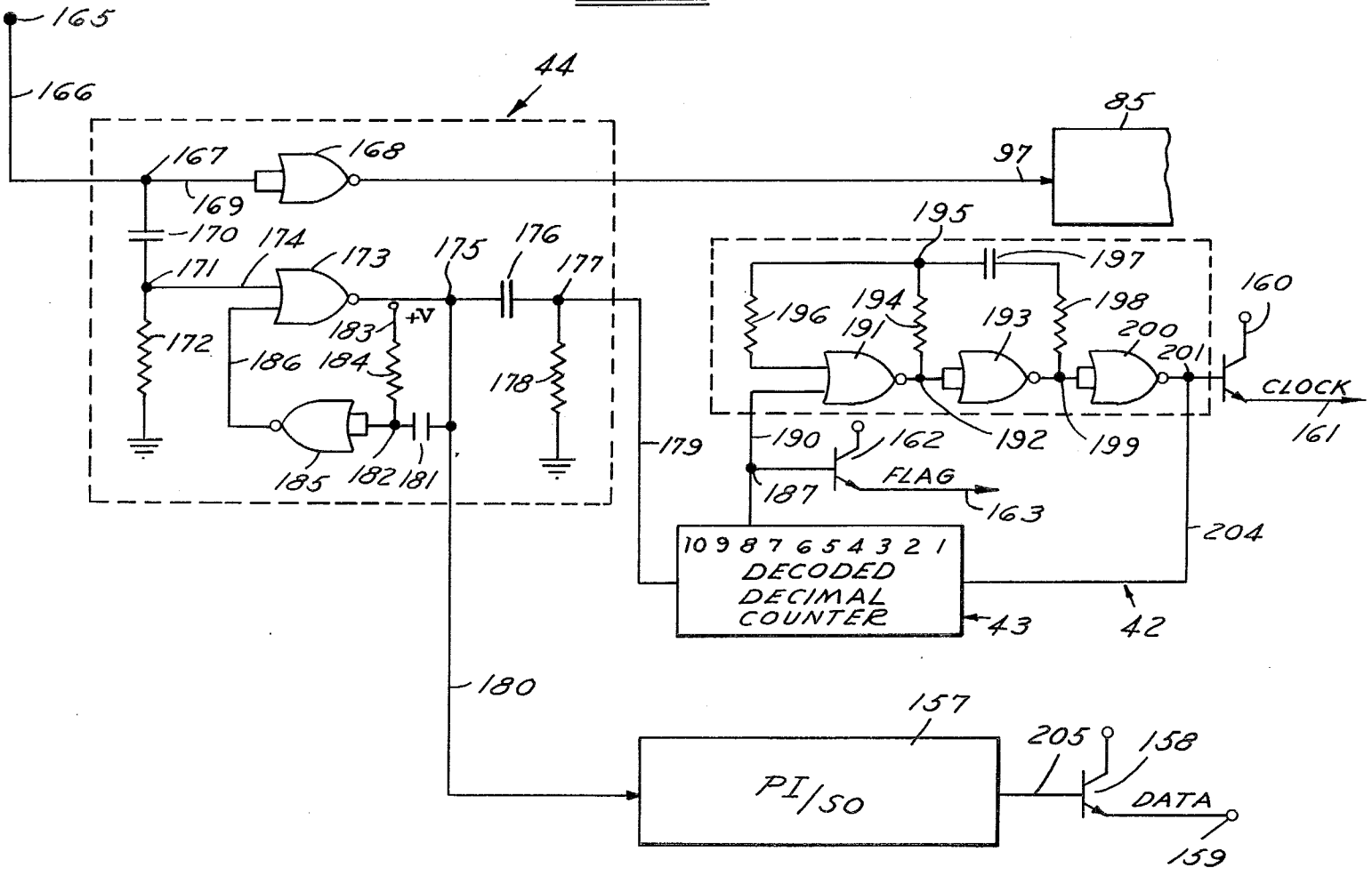
FIG. 9 is a detailed diagram of the clock and counter portions represented by block 164 of FIG. 8.

FIG. 9 shows a detailed description of the clock circuitry of block 42, the counter circuitry of block 43 and the logic circuitry of block 44 of FIG. 8. The output of the fifth or last stage of the counting shift register 104 is connected to the node 165 via lead 140. Node 165 is connected via lead 166 to a logic circuit node 167. When the last decimal digit of information has been entered into the encoder circuit 29 and the last shift pulse has been generated by the circuit 86 and output 99, the first high signal originally entered into the counting shift register 104 is shifted from the fourth to the fifth and last stage. This causes a high to appear on node 165 and hence, on node 167. Since node 167 is connected to the commonly coupled inputs of logical NOR gate 168 via lead 169 this high is inverted to present a low at the output of gate 168. The output of gate 168 is directly connected to the lock-out input 97 of the priority encoder 85 and a low at input 97 prevents the entry of any further decimal digits of information into the encoder 85 until the system has been cleared.

Additionally, the logic input node 167 is connected through a charging capacitor 170 to a node 171. Node 171 is coupled to ground through a resistor 172 and to a first input of a second logical NOR gate 173 via lead 174. The output of NOR gate 173 is connected directly to output node 175. Node 175 is connected through a second charging capactior 176 to a node 177 and node 177 is coupled to ground through a resistor 178 and to the reset input of a counter 43 via lead 179. The counter 43 may be, for example, a standard decoded decimal counter such as a CD-4017.

Node 175 is coupled directly to the clock input of the parallel-in/serial-out shift register 157 via lead 180 and to one plate of a third capacitor 181 whose opposite plate is connected to a node 182. Node 182 is connected to a source of potential 183 through a resistor 184 and directly to the commonly coupled inputs of a NOR gate 185 whose output is connected via lead 186 to the second input of logical gate 173.

In the preferred embodiment of the present invention, the parallel output of adder 145 supplies a four bit binary number of the parallel-inserial-out shift register 157 and the parallel outputs of adder 151 supply a similar four bit binary number to the parallel-inserial-out register 157. Therefore, the parallel-in/serial-out register stores as sequence of eight binary bits representing two binary numbers corresponding to the row and column address or coordinates of the matrix of lights 21.

Since there are eight bits in the sequence, the eight outputs of the decoded decimal counter 43 is connected to an output node 187 and node 187 is connected directly to the base of a bipolar driving transistor 162 whose emitter output or flag output 163 serves to output a "flag" pulse whenever the decoded decimal counter 43 has counted eight clock pulses. Node 187 is also connected via lead 190 to a first input of a logical NOR gate 191 of the clock circuit of block 42. The output of NOR gate 191 is taken from output node 192. Node 192 is directly connected to the commonly coupled inputs of a second logical NOR gate 193 and through a resistor 194 to a node 195. Node 195 is connected through a resistor 196 to the second input of the logical NOR gate 191 and through a series combination of a capacitor 197 and a resistor 198 to the output node 199 of the logical NOR gate 193. The output node 199 is connected directly to the commonly coupled inputs of a third logical NOR gate 200 whose output is connected directly to an output node 201. Output node 201 is connected directly to the base of a bipolar driving transistor 160 whose emitter serves as a clock output 161 as hereinafter described. Furthermore, the output node 201 is connected via lead 204 to the clock input of the decoded decimal counter 43.

In operation, when the high signal is transferred to the last stage of the counting shift register 104 in response to the receipt of the last shift pulse indicating that the final decimal of information has been entered, a high will be presented at the node 165. This high signal, in addition to the locking out the entry of further decimal digits of data into the priority encoder 85, will be supplied by the first input of a previously enabled NOR gate 173 causing its output to go low. The output of NOR gate 173 will stay level for the RC time constant of the combination of resistor 178 and compacitor 176 and thence it will shift and return high. When this momentary low is supplied via lead 179 to the reset input of the counter 43, the clock 42 is enabled to begin generating clock pulses at a predetermined frequency.

Clock pulses are generated at a predetermined frequency determined by the time constant of the oscillator comprising NOR gates 191, 193 and 200, the resistor 198 and the capacitor 197. These clock pulses are supplied via lead 204 to the clock input of the coded decimal counter 43. The counter 43 will count exactly eight of these pulses and then generate a clock termination output pulse at the eight output which is supplied to node 187. This termination pulse is supplied to the flag output 163 via driving transistor 188 and is supplied via lead 190 to disable NOR gate 191 thereby turning off the clock 42 to prevent the generation of any more clock pulses. The eight clock pulses which were counted by the decoded decimal counter 43 are supplied via lead 179, node 175 and lead 180 to the clock input of the parallel-inserial-out register 157 and used to step the eight binary bits stored therein which represent the two four bit binary numbers corresponding to the row and column coordinates of the given location out of the register 157 via lead 205. Lead 205 is connected to the base of a bipolar drive transistor 158 whose emitter serves as the data output 159 from which the eight binary bits are stepped in a serial manner for further processing as hereinafter described.

Figure 10:
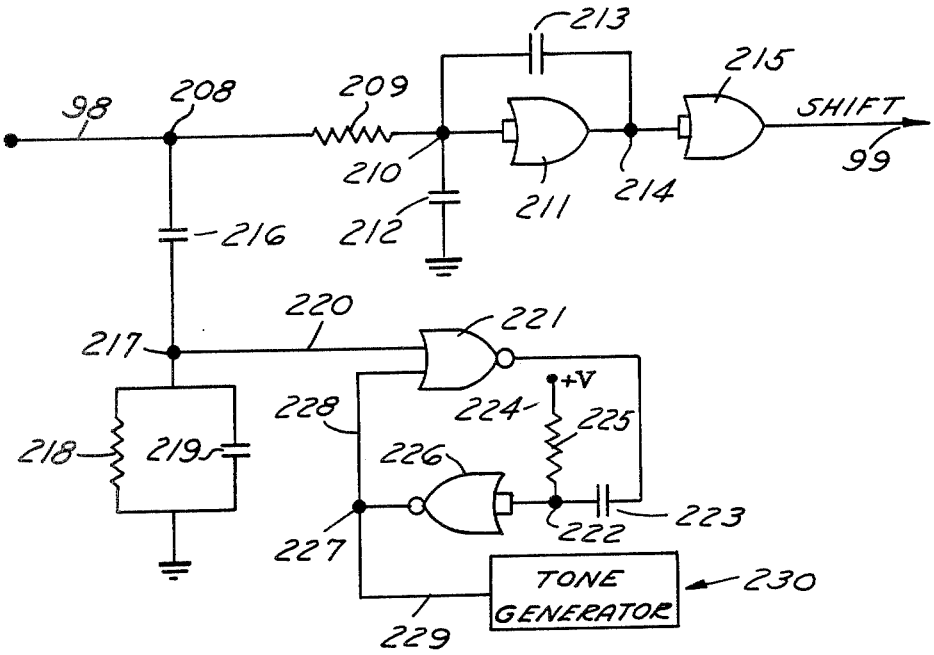
FIG. 10 illustrates a detailed systematic diagram of the shift circuitry of block 86 of FIG. 8.

FIG. 10 is a schematic diagram of the shift circuitry of block 86 of FIG. 8. Node 208 is connected to the "in use" signal output 98 of the priority encoder 85. Node 208 is then connected through a resistor 209 to a shift input node 210. Node 210 is connected to the commonly coupled inputs of a logical OR gate 211; to one plate of the first capacitor 212 whose opposite plate is connected to ground; and through a second historesis producing capacitor 213 to the output node 214 of the OR gate 211. The output node 214 is connected directly to the commonly coupled inputs of a second logical OR gate 215 whose output is used to supply the shift pulses via shift output 99.

The resistor 209 and capacitor 212 have an RC time constant which provides a predetermined delay period from the time of receipt of a high signal on lead 98 until the generation of the shift pulse at the output 99. The capacitor 213 and OR gate 211 provide a slight hysteresis so that the output of the shift pulse circuit 86 switches hard. The OR gate 215 serves to buffer the output of the OR gate 211 and the capacitor 212 further serves to provide a settling effect.

A second portion of the circuit of FIG. 10 is really associated with the audio circuitry of block 37 of FIG. 2 rather than with the specific shift circuitry of block 86 of FIG. 8 but will be described at this time. The node 208 is connected through a capacitor 216 to an input node 217. Input node 217 is connected directly to ground through the parallel combination of a resistor 218 and a capacitor 219. Furthermore, the node 217 is connected via lead 220 to a first input of a logical NOR gate 221. The output of a logical NOR gate 221 is connected to a node 222 via capacitor 223. Node 222 is coupled to a source of potential 224 through a resistor 225 and directly to the commonly coupled inputs of a second logical NOR gate 226. The output of the second logical NOR gate 226 is taken from output node 227 and coupled via lead 228 to the first input of the first logical NOR gate 221 and via lead 229 to a conventional tone generator 230 which may be, for example, a conventional sonalert device.

Tone generation circuitry can be used to generate a predetermined tone or tones to alert the operator at the central station to the fact that decimal digits of data are presently being entered into the priority encoder of block 29 and/or to indicate that the entry of data is complete different tones could be used to indicate different conditions as conventionally known.

Figure 11:
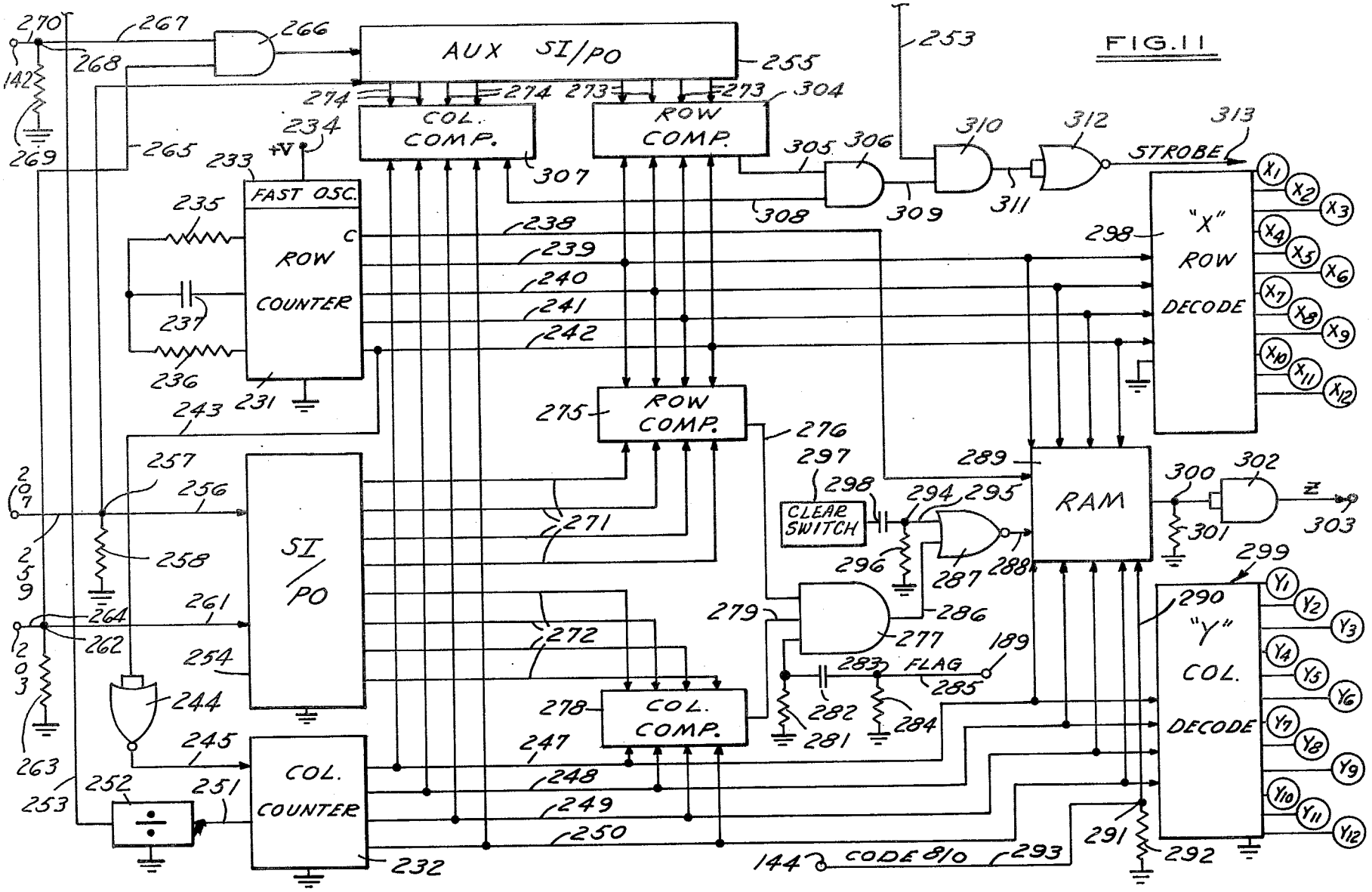
FIG. 11 represents a detailed systematic diagram of the scanning, comparing, memory and decoding circuits of the block diagram of FIG. 3.

FIG. 11 shows a detailed schematic diagram of the circuitry of FIG. 3 and is adapted to be used in conjunction with the encoder station circuitry of FIG. 8. FIG. 11 includes a row and column scanning counter 47 such as a standard RCA CD 4060 binary up counter having a first stage or row counter 231 and a second stage or column counter 232. The row counter 231 serves as a standard 16 bit binary up counter having a built-in fast oscillator or master clock 233 coupled to a source of potential 234. The master clock 233, row counter 231 combination may include the parallel combination of a first resistor 235 a second resistor 236 and a capacitor 237 as conventionally known. The row counter 231 has a clock output connected to lead 238 and a 1's, 2's, 4's and 8's output coupled to leads 239, 240, 241 and 242 respectively.

Furthermore, the last output of the row counter 231 is connected via lead 243 to the commonly coupled inputs of a logical NOR gate 244 which serves as an inverter. The output of NOR gate 244 is connected via lead 245 to the clock input of the column counter 232 so that the row counter 231 and the column counter 232 function as two stages of the same counter so as to produce a single 256 bit counter from two 16 bit counter stages. The column counter 232 is again a conventional 16 bit binary up counter having its clock input connected to the output of NOR gate 244 via lead 245 and another input connected to a source of potential 246. The 1's, 2's, 4's and 8's outputs of the column counter 232 are connected to leads 247, 248, 249 and 250 respectively. Furthermore, the last output of the column counter 232 may be connected via lead 251 to the input of a conventional divide-by-256 frequency divider 252. The output of the frequency divider 252 is connected to a lead 253 to provide a source of extremely slow clock pulses for use as hereinafter described.

The fast oscillator 233 serves as a master clock to generate master clock pulses at a predetermined relatively fast frequency such as one megacycle. The combination of the row counter 231 and the column counter 256 will count out 256 binary bits in a given count cycle. During a given count cycle, the lower ordered counts will generate row scan signals at the row scan outputs of the counter 231 and present the row scan pulses via leads 239 through 242 respectively. Since these outputs represent the 1's count, 2's count, 4's count and 8's count, they will be generated much more frequently than will be the column scan outputs from the column counter 232. The column scanning outputs are presented on leads 247 through 250 and correspond to the 16's, 32's 64's and 128's binary positions and output signals therefrom will serve to address or scan the various column addresses. As conventionally known, for every one of the column scan signals outputted from the column counter 232, each and every one of the possble row counter scan signals will have been outputted on the leads 239 through 242 of the row counter 231.

The circuit of FIG. 11 also includes a conventional serial-in/parallel-out register 254 and an auxiliary serial-in/parallel-out register 255. The register 254 has its data input connected via lead 256 to data input node 257. Data input node 257 is also connected through a resistor 258 to ground; through a lead 259 to the data output 207 of the circuit of FIG. 9; and through a lead 260 to the data input of the auxiliary serial-in/parallel-out register 255. Similarly, the clock input of the serial-in/parallel-out register 254 is connected via lead 261 to a clock input node 262. The clock input node 262 is also connected to ground through a resistor 263; to the clock output 203 via lead 264; and via lead 265 to a first input of a logical AND gate 266.

The other input to the logical AND gate 266 is connected via lead 267 to an input node 268. Node 268 is connected to ground through a resistor 269 and via lead 270 to the Code 4 output 142 of the circuit of FIG. 8. Therefore, whenever the Code 4 signal is decoded by the shift registers 37, the AND gate 266 is enabled to receive the clock pulses from node 262 which enable the data from ode 257 to be entered into the auxiliary serial-in/parallel-out register 255. Conversely, whenever the Code 4 signal has not been entered into the priority encoder 85, the AND gate 266 will be disabled by the presence of a low signal at the Code 4 output 142, thereby preventing the auxiliary serial-in/parallel-out shift register 255 from receiving the data via lead 260.

The serial-in/parallel-out registers 254 and 255 receive the clock pulses and the eight serial bits of data as they are stepped out of the parallel-in/serial-out register 157 of FIG. 8 and store the binary numbers represented by those eight bits of data for serial output therefrom. A first set of four outputs 271 serve to output the four binary bits stored within the register 254 which correspond to the binary number representing the row coordinate or address of the given location entered into the priority encoder circuitry 29. A second set of four ouputs 272 of the register 254 serve to output the second set of four binary bits of data which represent the second binary number which in turn represents the column coordinate or address entered into the priority encoder circuitry 29. Similarly, a first set of parallel outputs 273 from the auxiliary register 255 serve to output the binary number representing the entered row coordinates while a second set of parallel outputs 74 serves to output the binary number representing the entered column coordinates.

The first set of row outputs of the serial-in/parallel-out register 254 which store the binary number representing the row address previously entered into the priority encoder circuitry 29 of FIG. 2, are supplied to a first set of inputs of a row comparator 275 having its second set of inputs connected directly to the row scan outputs 239 through 242 of the row counter 231. Whenever the two sets of inputs are equal, which occurs whenever the row address or coordinate being scanned by the outputs of the row counter 231 become equal to the binary number present at the outputs 271 of the serial-in/parallel-out register 254 representing the entered row address, the comparator output will present a "row equal" signal on comparator output lead 276. Lead 276 is connected to a first input of a logical AND gate 277.

Similarly, a column comparator 278 has its first set of inputs connected to the second set of parallel outputs 272 from the serial-in/parallel-out register 254 which store the binary number representing the entered column address and its second set of inputs connected to the column scan outputs 247 through 250 of the column counter 232. When the two sets of inputs are equal, which occurs when the count present at the scanning outputs 247 through 250 of the column counter 232 reach a count equal to the binary number stored on the second set of outputs 272 of the register 254 which corresponds to the entered column coordinates or address then a "column equal" output signal is outputted from the column comparator 278 and supplied via lead 279 to a second input of logical AND gate 277. The third and final input of AND gate 277 is connected to an input node 280. Node 280 is connected to ground through a resistor 281 and through a capacitor 282 to a second node 283. Node 283 is connected to ground through a resistor 284 and to the flag output 163 of the counter 43 of FIGS. 8 and 9 via lead 285.

When the decoded decimal counter 43 reaches the eight count, the output at node 187 goes high causing a high signal to appear at the flag output 163. This flag signal is supplied via lead 285 to the third input of AND gate 277 to enable the AND gate whenever the transfer of data from the parallel-in/serial-out shift register 157 to the serial-in/parallel-out register 254 is complete. Therefore, as soon as the "row equal" signal and the "column equal" signal exist simultaneously at the first and second inputs via leads 276 and 279 respectively, the output of logical AND gate 277 will supply a "write enable" signal via lead 286 to one input of a logical NOR gate 287. The output of the logical NOR gate 287 is connected via lead 288 to the "write enable" or write command port of a one bit random access memory 289 so that when a "write enable" signal is presented on the lead 288, the random access memory 289 will write into the row and column memory address currently being scanned the signal present at its data input.

The data input is connected via lead 290 to a memory input node 291. The node 291 is connected to ground through a resistor 292 and via lead 293 to the Code 8/0 output 144 of FIG. 8. Therefore, whenever the instructional command "eight" is entered as the command digit into the priority encoder circuit 29, the shift registers 37 will decode the instructional command and output a high signal at the code eight output 144. This high signal will be presented to the data input of the memory 289 via leads 293 and 290 so that when the row and column memory address is scanned which is equal to the row and column coordinates entered into the encoder circuit 29, the high signal will write a zero into the negative logic of the random access memory 289 at the row and column address corresponding to the entered coordinates.

The second input of the logical NOR gate 287 is enabled by the normally low signal at input node 294. Node 294 is connected directly to the second input of NOR gate 287 via lead 295. Node 294 is also connected to ground through a resistor 296 and to a clear switch 297 through a capacitor 298. The clear switch 297 is connected to a source of potential and may be closed to disenable the NOR gate 287 to clear the random access memory 289. The switch 297 may be used to write ones or zero into all memory locations to test the memory, the power supply, the display board etc. The clock input of the memory 289 is connected to the clock output of the row counter 231, oscillator 233 via lead 238. The memory 289 includes a first set of row scanning address lines which are coupled to the row scan outputs 239–242 of the counter 231 and a second set of column scanning address lines which are connected to the column scan outputs 247 through 250 of the column counter 231. The row and column scanning address lines enable the memory 289 to sequentially scan the row and column addresses to write the signal present at its memory input 290 whenever the write enable signal is present at 288.

The row scan outputs 239, 240, 241 and 242 from the row counter 231 are connected directly to the four inputs of a four line to sixteen line row decoder 298. The decoder 298 is responsive to the four bit binary input to sequentially generate a sequence of scanning pulses $X_1$ through $X_{12}$ for sequentially addressing the twelve rows of the matrix of lights 21 of the display board 20 of the present invention.

Similarly, a four-line to sixteen-line column decoder 299 as its four binary inputs connected to the column scan outputs 247, 248, 249, 250 of the column counter 232 so that the decoder 299 outputs a series of column scan signals corresponding to the binary numbers presented at its inputs. In the present example, twelve of the separate and distinct outputs are $Y_1$ through $Y_{12}$ are used to address the twelve separate and distinct columns of the matrix of lights 21 of the display board 20 in the present invention.

The output of the random access memory 289 is connected directly to a memory output node 300. The node 300 is connected to ground through a resistor 301 and to the jointly coupled inputs of a logical AND gate 302 which serves to buffer the memory output. The output 303 of the AND gate 302 represents the intensity modulation signal "Z" which corresponds to the value of the Code 8/0 signal written into each of the addressed memory locations of the random access memory 289.

The first set of outputs 273 of the auxiliary serial-in/parallel-out register 255 are connected directly to a first set of inputs of a second row comparator 304 whose second set of inputs is connected directly to the row scan outputs 239 through 242 of the row counter 231. When the inputs are equal, the comparator 304 will output a "row equal" signal which is supplied via lead 305 to a first input of logical AND gate 306.

A second column comparator 307 has its first set of inputs coupled to the second set of outputs 274 of the auxiliary register 255 for receiving the binary number representing the entered column address and its second set of inputs coupled to the column scan outputs 247 through 250 of the column counter 232. When the two sets of inputs are equal, the column comparator 307 will output a "column equal" signal via lead 308 which is connected to the second input of the logical AND gate 306.

Therefore, AND gate 306 will output a high signal whenever both the row enable and the column enable signals are present simultaneously. The output of AND gate 306 is connected via lead 309 to a first input of the second logical AND gate 310. The other input to the second AND gate 310 is connected via lead 253 to the output of the frequency divider 252 which supplied relatively slow clock pulses for enabling the gate 310. Therefore, whenever the gate 310 is enabled by the presence of one of the clock pulses on lead 253, the gate will output a high signal whenever the row equal and column equal signals are simultaneously present at the inputs to AND gate 306. This output of AND gate 310 is coupled via lead 311 to the commonly coupled inputs of a logical NOR gate 312 which serves as an inverter. The output 313 of the NOR gate 312 serves as a strobe output as hereinafer described.

In operation, a circuit of FIG. 11 operates as follows. The eight binary bits of data representing the four bit binary number indicative of the entered row address and the four bit binary indicative of the entered column address is received at the data input of the serial-in/parallel-out register 254 and clocked therein by the eight clock pulses to arrive at input node 257. If a Code eight or Code zero instructional command were entered with the row and column coordinates, the auxiliary register 255 will not be enabled but the primary register 254 will. The entered row address will be present at the outputs 271 and fed to the row comparator 275 while the column outputs 272 which store the binary number representing the entered column address are presented to the first set of inputs of the column comparator 278.

The other set of inputs of the row comparator 275 will be supplied by the row scan pulses from the row counter 231 while the second set of inputs to the column comparator 278 will be taken from the column counter 232. When the row comparator 275 has its inputs equal and the column comparator 278 has its inputs equal, the previously enabled AND gate 277 will be caused to gate a high write enable signal which allows the random access memory 289 to write in the code eight or code zero signal into the correct memory address. When the individual lights 21 of the matrix of the display board 20 are addressed by the outputs of the row decoder 298 and the column decoder 299, the Z output 303 of the random access memory 289 will be logically gated together so that the individual lights corresponding to the previously entered row and column addresses will be termed steady on or steady off depending on whether a code eight or a code zero instructional command was entered.

Similarly, if a Code four instructional command were entered, the auxiliary register 255 will be enabled and AND gate will output a high signal whenever the row comparator 304 generates a "row equal" signal at the same time that the second column comparator 307 outputs a "column equal" signal. The high on lead 309 will generate a strobe pulse at output 313 which is gated to cause a light currently addressed to blink on and off.

Figure 5:
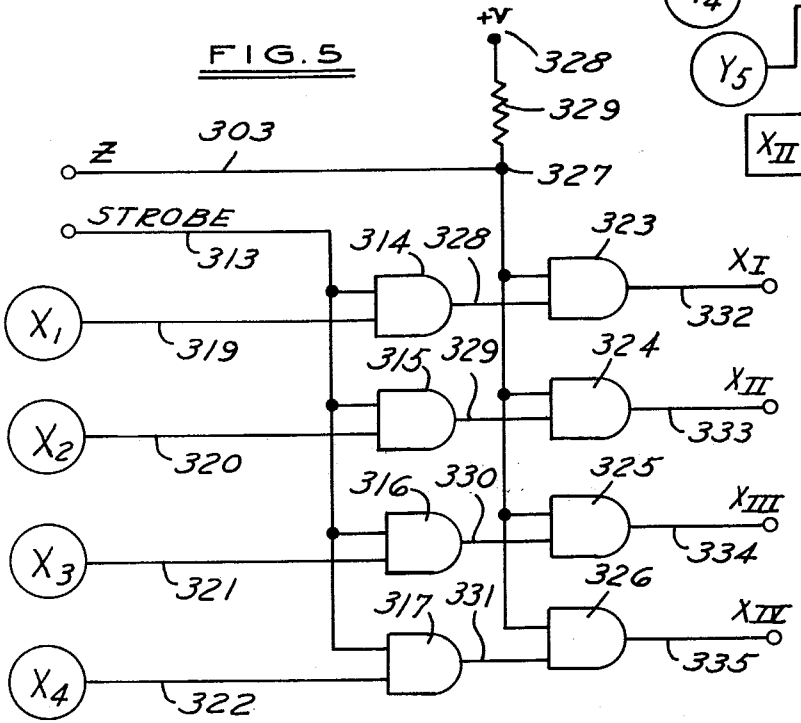
FIG. 5 is a systematic diagram illustrating one section of a first stage of gating means used to address the various rows of the display matrix.

FIG. 5 represents one of three identical gating circuits used to sequentially address the separate and distinct rows of the matrix of light 21 of the display board 20 of the present invention. Each of the circuits is identical to that of FIG. 5 and each address is four separate rows of the matrix. The circuit of FIG. 5 includes a first set of four logical 314, 315, 316 and 317. Each of the first set of AND gates 314 through 317 has its first input connected via lead 318 to the strobe 313 of the circuit of FIG. 11. Therefore, each of the AND gates 314 through 317 is enabled when the strobe pulse is high and turned off when the pulse is low to provide effect when the code 4 command instruction has been entered as previously described. The second input of AND gate 314 is connected via lead 319 to the $X_1$ row scan output of the decoder 298. The second input to AND gate 315 is connected via lead 320 to the $X_2$ output of the decoder 298 while the second input to AND gate 316 is connected via lead 321 to the $X_3$ output and the second input to AND gate 317 is connected via lead 322 to the $X_4$ output of the decoder 298.

The second set of logical AND gates 323, 324, 325 and 326 each has one input connected via node 327 to the Z modulation output 303 of the circuit of 311. Node 327 is also connected to a source of potential 328 through a resistor 329. Therefore, a high signal will be presented to the first input of each of the AND gates 323 through 326 whenever the scanned memory output indicates that a code eight instruction was stored therein. The second input to AND gate 323 is connected via lead 328 to the output of the AND gate 314; the second input of AND gate 324 is connected to the output of AND gate 315 via lead 329; the second input to AND gate 325 is connected via lead 330 to the output of AND gate 316 and the second input to AND gate 326 is connected via lead 331 to the output of AND gate 317. Therefore, the output of the AND gate 323 will provide a gated row scan signal $X_1$ whenever the row scan signal $X_1$ is generated and the intensity modulation signal Z indicates a code eight condition. The output 333 of the second AND gate 324 will output a gated row scan pulse $X_{II}$ *whenever the X2* signal is outputted from the row decoder 298 and the intensity modulation signal Z indicates a code eight condition. Similarly, the output 334 of the third AND gate 325 will generate a gated row scan signal $X_{III}$ and the output 335 of the fourth AND gate 326 will provide agated row scan signal $X_{IV}$ under the appropriate conditions.

The eight row scan signals $X_I$ through $X_{XII}$ are used to address the twelve rows of individual lights 21 of the display board 20 as indicated by the matrix panel portion of FIG. 6 wherein the gated row scan outputs $X_I$ and $X_{III}$ are used to address the first two rows of the matrix. Each of the columns within the given rows are then addressed by the $Y_1$ through $Y_{XII}$ outputs of the column decoder 299 as previously described with respect to FIG. 6.

Therefore, whenever the row and column coordinates defining the location of an incident warranting police attention have been entered into the priority encoder circuitry of block 29 of FIG. 2, such as by an operator at the central station utilizing the manual keyboard 30 to enter 2 decimal digits of information defining the row address and two decimal digits of information defining the column address and a fifth decimal digit for command digit is entered to specify the illumination status of the address light, such as a code four which indicates that the light located at the address row and column location is to blink on and off, this information is stored in the appropriate location of a random access memory 289. The individual rows and columns of the matrix individual light 21 is addressed by gating means such that at each of the address locations is sequentially scanned, those lights corresponding to address locations which were entered to indicate the location of occurrence warranting police locations will be identified by their light blinking on and off.

Similarly, the individual locations of the police cars are entered with a Code eight command indicating that their light is to be placed in a steady on condition. The memory output will be gated with the outputs of the row and column decoders so that the individual lights of the matrix will be sequentially addressed and those lights corresponding to the locations of the patrol cars will appear to be steadily on so that a dispatcher observing the display board 20 will be able to readily observe the distance of each of the patrol cars, as indicated by the steady lights, from the location of the incident warranting police attention, as indicated by the location of the blinking light, to facilitate the dispatcher in making command and control decisions.

An alternate embodiment of the present invention may eliminate the AND gate 310 and NOR gate 312 and substitute therefore a second NOR gate and random access memory combination similar to the NOR gate 287 and RAM 289 so that two identical comparator and memory systems are available, one for the primary register 254 and one for the auxiliary register 255. In this example, the gating circuitry used to address the matrix would be correspondingly modified.

Figure 12:
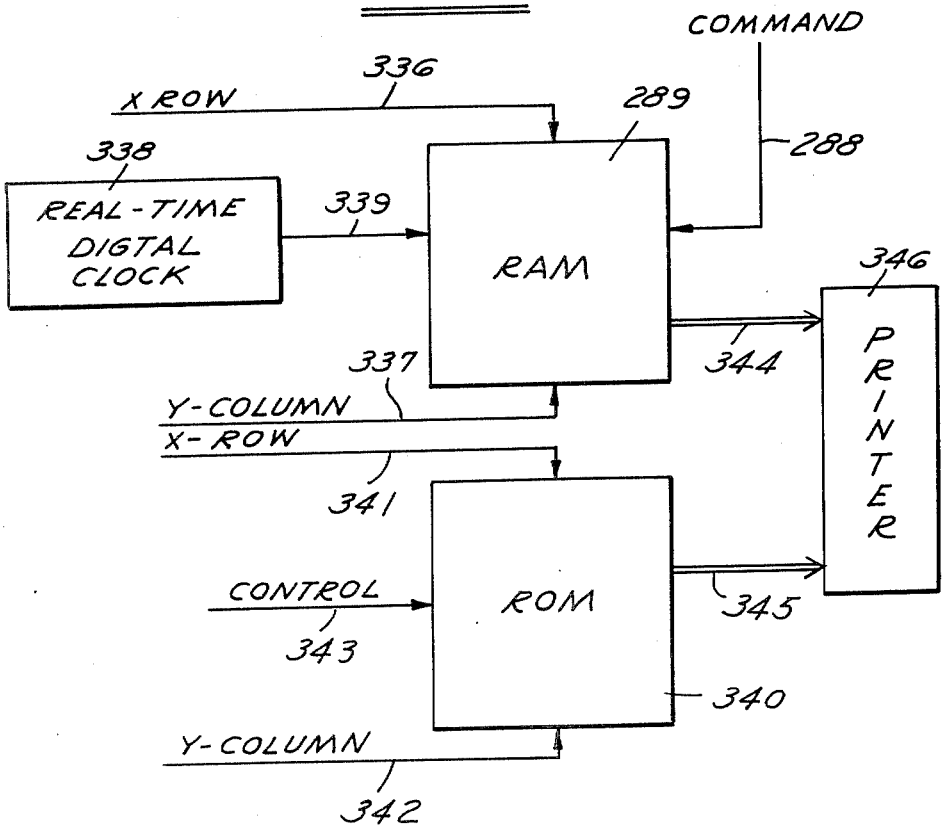
FIG. 12 is a block diagram of an alternate embodiment of the present invention wherein the vehicle identification and location are recorded on a printer along with the actual time at which the memory information was last updated.

FIG. 12 is still another alternate embodiment of the vehicle location system of the present invention wherein the random access memory 289 has its first set of row scan inputs connected to the outputs of the row counter 231 as represented by path 336 and its second set of column scanning inputs connected to the scanning outputs of the column counter 232 by the path 337. A real time digital clock 338 continually provides a digital indication of the time of day via lead 339 to the data input of the random access memory 289. The write enable signal will be supplied via lead 288 to instruct the random access memory 289 to enter the time in the appropriate address location thereof.

A read only memory 340 is also provided and it has a first set of row scan inputs connected via path 341 to the scan outputs of the row counter 231 and a second set of column scan inputs connected via path 342 to the column scan outputs of the column counter 232. The read only memory (ROM) 340 has a control input 343 for entering data into the appropriate memory location of the ROM 340 such as the car identification and/or status. An output 344 of the RAM 389 and the output 345 of the ROM 340 are connected to a conventional printer 346 for making a permanent printed record of the information such as the identification, location and/or status of the police car plus the actual time of day at which the entry was made.

In the preferred embodiment of the present invention, all of the circuits of the vehicle locator system of the present invention utilize standard C-MOS logic and operates off a twelve volt system which is capable of working down to about five volts. Since the operation of the row and column scanning counter 47 and the row and column decoders 52 and 53 creates a multiplexing effect which results in the individual lights of the display board being on only a fraction of the normal time thereby greatly decreasing the cost and power consumption of the system and greatly prolonging the useful life of the individual lights 21 to reduce maintenance expenses. The system of the present invention is extremely simple and employs off-the-shelf chips with relatively few circuit modifications. The system can be constructed at an extremely low cost and its high reliability and ease of use renders it far superior to even the more costly systems of the prior art.

The detailed description of the preferred embodiment of the present invention makes specific reference to a number of decimal digits of information entered into the system, of the number of binary bits used in various instructions, counters and the like and in the number of rows and columns of the matrix of lights currently utilized but it will be obvious to those of ordinary skill in the art that various modifications can be made in these perameters and in the various circuits of the system of the present invention without departing from the spirit and scope thereof which is limited only by the appended claims.

I claim:

1. A positional display system of visually indicating a given location such as the location of a motor vehicle such as a police car or the location of the occurrence of an incident warranting police attention to aid in making command and control decisions, said positional display system comprising:

a display board including a row and column matrix of individual lights and a map overlaying said matrix so that each of said individual lights represents a unique locational area of said map;

means for inputting a sequence of decimal digits of information including a first set of decimal digits indicative of the specific row address of a given locational area of said map, a second set of decimal digits indicative of the specific column address of a given locational area of said map and a third set of at least one command digit for determining the desired status of illumination of the individual light located at said given row and column address on said display board;

means for converting each of said sets of decimal digits of information into their binary equivalents such that said first set of decimal digits is represented by a first binary number having "m" bit positions, said second set of decimal digits is represented by a second binary number having "n" bit positions and said third set of at least one command digit is represented by a third binary number;

means for temporarily storing said binary numbers, said storage means including a first set of outputs for outputting said first binary number, a second set of outputs for outputting said second binary number and means responsive to a first value of said command digit for generating a "light on" signal and to a second value of said command digit for generating a "light off" signal;

scanning means including a $2^{m+n}$ bit binary up counter having a first set of "m" outputs corresponding to the first "m" bit positions of the counter and a second set of "n" outputs corresponding to the next successive "n" bit positions of the counter;

row comparator means having a first set of comparator inputs coupled to the first set of outputs of said temporary storage means, a second set of comparator inputs coupled to said first set of "m" outputs of said binary up counter and a comparator output for supplying a "row equal" signal when equivalency exists between said row comparator inputs;

column comparator means having a first set of comparator inputs coupled to said second set of outputs of said temporary storage means, a second set of comparator inputs coupled to said second set of "n" outputs of said binary up counter and a comparator output for supplying a "column equal" signal when equivalency exists between said column comparator inputs;

memory means having at least $2^m$ row by $2^n$ column memory locations, input means coupled to said first set of "m" outputs of said binary up counter for scanning said row addresses in said memory and to said second set of "n" outputs of said binary up counter for scanning said column addresses, said memory means further including a write input coupled to said temporary storage means for presenting said "light on" signal and said "light off" signal thereto and a write enable port responsive to the presence of a "write enable" signal for enabling said memory means to write said "light on" and "light off" signals into the memory location then being addressed by said scanning means and a memory output for reading out the "lights on" or "lights off" signal stored in each of said memory locations;

gating means coupled to the outputs of said row and column comparator means for generating a "write enable" signal when said "row equal" and said "column equal" signals exist simultaneously;

row decoder means coupled to said first set of "m" outputs of said scanning means for sequentially addressing the rows of said matrix;

column decoder means coupled to said "n" outputs of said scanning means for sequentially addressing the $2^n$ columns of said matrix; and logical gating means responsive to the output of said row decoder means, the output of said column decoder means, and the output of said memory means for sequentially addressing each of said lights in said matrix and for selectively energizing a given light in said row and column matrix when the command digit entered with said given row and column coordinate so dictates thereby visually displaying the location of said motor vehicle or incident on said display board for command and control purposes.

2. The positional display system of claim 1 wherein each of said individual lights of said row and column matrix includes a light-emitting diode and said row and column matrix further includes a darlington amplifier associated with each of said light emitting diodes, the base input of said darlington amplifier being connected to a control input while the commonly coupled collectors of said darlington amplifier are connected to a source of potential and the output emitter is coupled to the anode of said light emitting diode whose cathode is resistively coupled to ground.

3. The positional display system of claim 2 wherein said light emitting diode and darlington amplifier circuitry further includes an input diode having its anode connected to the control input for controlling the operation of the light emitting diode and its cathode connected to a base input of said darlington amplifier, the cathode of said input diode and the base of said input darlington transistor being capacitively coupled to ground for smoothing out flicker problems in closed circuit television applications.

4. The positional display system of claim 1 wherein said inputting means includes a manually operable ten-key keyboard for manually entering in a serial manner the decimal digits zero through nine as required for defining the row and column coordinates of a given location and the desired status of illumination of the individual light corresponding thereto.

5. The positional display system of claim 1 wherein said inputting means includes a plurality of card media each of which has encoded thereon the locational row and column coordinates of a given location at which an incident warranting police attention may occur and a card reader means for reading the encoded information stored on one of said card media for inputting said sets of decimal digits of information when one of said card media corresponding to the location of the occurrence of an incident warranting police attention is selectively fed into said card reading means.

6. The positional display system of claim 1 wherein said inputting means includes an acoustical tone decoder for generating said decimal digits of information in response to incoming audio tone signals.

7. The positional display system of claim 6 wherein said inputting means further includes a two-line to ten-line telephone audio tone generator for supplying said input tones.

8. The positional display system of claim 6 wherein said inputting means further includes an intercom system for inputting said audio tones to said acoustical decoder.

9. The positional display system of claim 6 wherein said inputting means further includes a radio receiver for receiving radio signals and inputting the audio tones resulting therefrom to said acoustical decoder.

10. The positional display system of claim 1 wherein said decimal to binary converting means includes means for sequentially receiving one decimal digit of inputted information at a time and for converting that decimal digit of information into a four bit binary coded decimal number having a 1's position value, a 2's position value, a 4's position value and an 8's position value, said converting means further including delay circuitry means for generating a shift pulse in response to the completion of conversion of each of said decimal digits into its binary coded decimal equivalent and means for preventing the entry of additional decimal digits of information until the decimal digit currently being inputted has been converted and said shift pulse generated.

11. The positional display system of claim 1 wherein said inputting means includes a ten-key decimal keyboard having one key for each of the decimal digits zero through nine, said converting means including encoding means having eight inputs corresponding to the decimal digits zero through seven and three binary outputs corresponding to the 1's, 2's and 4's binary bit positions for converting the unique decimal digit input into a corresponding binary output, said converting means also including a first logical "OR" gate having its output connected to the zero input of said encoding means, a second logical "OR" gate having is output connected to the one input of said encoder means, one input of said first logical "OR" gate being coupled to said zero key of said input means and the other input of said first logical "OR" gate being connected to said eight key, one input of said second "OR" gate being connected to said one key of said input means and the other input of said second "OR" gate being connected to said nine key, said converting means further including a first logical "NOR" gate having first and second gate inputs and a gate output, a second logical "NOR" gate having first and second gate inputs and a gate output, and a third logical "NOR" gate having first and second gate inputs and a gate output, said first input of said first "NOR" gate being connected to said eight key and said second input of said first "NOR" gate being connected to said nine key, said output of said first logical "NOR" gate being connected to said first input of said second logical "NOR" gate said output of said second "NOR" gate serving to provide the 8's binary bit position of said converted number, said second input of said second logical "NOR" gate being connected to the inverted output of said third logical "NOR" gate and, said first input of said third "NOR" gate being connected to said 2's binary bit position output and said second input of said third "NOR" gate being connected to said 4's binary bit position output of said encoding means.

12. The positional display system of claim 11 wherein said encoding means includes a first encoder output for supplying a first signal when one of said keys are depressed for entering a decimal digit of information, said encoding means also including means for generating a shift pulse including a resistor coupled between said first encoder output and a common node, a capacitor coupled between said common node and ground for providing a settling effect to said shift pulse generating circuit, a first logical "OR" gate having its commonly coupled inputs connected to said common node, and a second capacitor connected between said common node and the output of said first logical "OR" gate said encoding means further including a second logical "OR" gate having its commonly coupled inputs connected to the output of said first logical "OR" gate for buffering the output thereof and supplying said shift pulse at the output of said second "OR" gate upon the completion of conversion of each of said decimal digits information into binary coded decimal form.

13. The positional display system of claim 11 wherein said temporary storage means includes a 1's position shift register having its input connected to the 1's position output of said decimal to binary converting means, a 2's position shift register having its input connected to the 2's position output of said decimal to binary converting means, a 4's position shift register having its input connected to the 4's output of said decimal to binary converting means and an 8's position shift register having its input connected to the 8's output of said decimal to binary converting means, each of said shift registers including at least one stage for each decimal digit of information being inputted, each of said shift registers being adapted to receive a "1" or "0" value from the corresponding binary bit position of the most recently converted decimal digit and each of said shift registers being responsive to said shift pulse indicative of the completion of conversion of the most recently entered decimal digit for shifting the contents of the shift register to the next higher stage so as to enable said shift registers to await the conversion of the next decimal digit of information to be inputted, each of said shift registers having shift register outputs corresponding to each of the stages thereof.

14. The positional display system of claim 13 wherein said temporary storage means further includes a fifth shift register having a signal input connected to a source of potential and a shift input connected to said source of shift pulses, said fifth shift register having one stage for each of said decimal digits of information being inputted, each of said shift register stages having an output therefrom, the output from the last stage of said fifth shift register operating to provide an "entry completed" signal when the last decimal digit of information has been inputted and the last shift pulse has been counted, said converting means further including logical gating means responsive to the receipt of said "entry complete" signal for locking out the inputting of any further decimal digits of information to said converting means until said shift registers are cleared.

15. The positional display system of claim 13 wherein said display system includes a plurality of visual indicator means, one for each decimal digit of information to be entered and a decoder means associated with each of said indicator means, the inputs of each of said decoder means being coupled to the outputs of the stages of each of said shift registers so as to decode each stored binary number and visually display the decimal digit corresponding thereto on said indicator means.

16. The positional display system of claim 13 wherein said temporary storage means includes a first means coupled in parallel with the outputs of those stages of said shift registers storing the row coordinates for receiving the binary number representative thereof in a first sequence of binary digits and a second means coupled in parallel with the outputs of those stages of said shift registers storing the column coordinates for receiving the binary number representative thereof in a second sequence of binary digits so that the first and second sequence of binary digits are arranged in a consecutive serial manner.

17. The positional display system of claim 14 wherein said temporary storage means includes a parallel-in/serial-out register for receiving, in parallel, a sequence of binary numbers indicative of the row and column coordinates of said location and for storing said sequence in a serial array, said temporary storage means including a high speed clock means for generating pulses at a predetermined rate, a counter responsive to the pulses generated by said clock means for counting out a predetermined number of clock pulses equal to the number of binary bits in said sequence stored in said parallel-in/serial-out register, and logic means coupled to the last output of said fifth shift register and responsive to the generating of said "entry completed" signal for initiating the operation of said clock, and means to allow said counter to output said predetermined number of clock pulses, said counter being responsive to the attainment of said predetermined count for terminating the operation of said clock means and means for coupling the predetermined number of clock pulses to said parallel-in/serial out register for serially stepping out the binary bits of said sequence in a serial manner.

18. The positional display system of claim 17 wherein said temporary storage means further includes a serial-in/parallel-out register for receiving said predetermined number of clock pulses and said serial sequence of binary bits for storing said sequence for parallel output so that the first sequence representing said first binary number indicative of the row address of said location is provided at a first set of parallel outputs and the second sequence of binary numbers representative of the column address is provided at a second set of parallel outputs, said first set of parallel outputs corresponding to said first set of outputs of said temporary storage means and being coupled to said first set of comparator inputs of said row comparator whereas said second set of parallel outputs corresponds to said second set of outputs of said temporary storage means and is coupled to said first set of comparator inputs of said column comparator.

19. The positional display system of claim 1 wherein said scanning means includes a master clock for generating clock pulses at a predetermined frequency and a binary up counter having a first $2^m$ bit binary section having "m" output stages and a second $2^n$ bit binary section having a "n" output stages the input of said second counter section being coupled to the "m" output stage of the first counter section so that the two counter sections are coupled to count $2^{m+n}$ bits, the first set of "m" outputs of said first counter outputting the row scanning pulses, said row scanning outputs being coupled to said first set of said row comparator inputs, to first set of row scanning inputs of said memory means and to the inputs of said row decoder means while said second set of column scanning outputs are coupled to said first set of column comparator inputs, to the second set of column scanning inputs of said memory means and to the inputs of said column decoder means, said memory means being responsive to the scanning of said row and column inputs for outputting signals indicative of the status of illumination of each of the scanned row and column addresses thereof.

20. The positional display system of claim 19 wherein said system further includes a second serial-in/parallel-out register for receiving said predetermined number of clock pulses and the serial sequence of binary numbers and storing same for parallel output therefrom, said second serial-in/parallel-out register having first and second sets of parallel outputs, said system still further including a second row comparator means having first and second sets of inputs and a second row comparator output, said first set of comparator inputs being coupled to said first set of outputs of said second serial-in/parallel-out register which stores the binary number representing of the row address of said entered location and said second set of second row comparator inputs being coupled to said first set of row scanning outputs of said binary up counter, said system further including a second column comparator means having first and second sets of inputs and a comparator output, said first set of column comparator inputs being coupled to said second set of outputs of said serial-in/parallel-out register which stores to the binary number representing the column address of said entered location and said second set of column comparator inputs coupled to said second set of column scanning outputs of said binary up counter, said second row comparator outputting a "row equal" output pulse when equality exists between its first and second sets of inputs and said second column comparator generating a "column equal" output pulse when its first and second sets of inputs are equal, a first logical "AND" gate having one input coupled to the output of said second row comparator and the other input coupled to the output of said second column comparator so that the output of said first "AND" gate is high only if the "row equal" and "column equal" outputs occur simultaneously, said system further including frequency divider means coupled to an output of said binary up counter for generating a sequence of relatively slow clock pulses, a second "AND" gate having one input connected to the output of said frequency divider means and its other input connected to the output of said first "AND" gate, the output of said second "AND" gate supplying a gated strobe pulse, said second serial-in/parallel-out register including a serial input for receiving said serial sequence of binary bits from said parallel-in/serial-out register and a clock input coupled to the output of a third "AND" gate having one input coupled to said source of a predetermined number of clock pulses and its other input coupled to the output from the appropriate stage of an appropriate one of said shift registers so as to output a "blink light" signal when a third value of said command digit which is inputted directs that the light located at said given row and column address is to be alternately blinked on and off so that said second serial-in/parallel-out shift register is only operable when said third value command digit has been entered.

21. The positional display system of claim 1 wherein said row decoder means includes a separate and distinct output for each of the "x" rows of said matrix, said column decoder means includes a separate and distinct output for each of the "y" columns of said matrix, and said logical gating means includes a first set of "x" AND gates each having one input coupled to a corresponding "x" output of said row decoder means and its second input coupled to said source of gated strobe pulses, said logical gating means further including a second set of "x" AND gates each having one input connected to a corresponding output of said first set of "x" AND gates and its second input connected to said memory output so that the output of said second AND gate goes high only when the appropriate row is scanned and the "lights on" command has been entered in the corresponding location of said memory, said logical gating means lastly including a third set of AND gates arranged in "x" rows, each row having "y" gates therein, the output of each of said third set of AND gates being connected to a light input for energizing said light when both gate inputs are high, one input of each of the third AND gates in a given row being connected to the output of a corresponding one of said second set of AND gates and the other input of each of the third AND gates in each column being connected to a corresponding "y" output of said column decoder means so that the light corresponding to each row and column position of said matrix is illuminated only if the command digits inputted dictated a "light on" instruction and an illuminated light is blinked on and off by the operation of said strobe pulse output whenever the command digit inputted so dictates thereby allowing an operator to enter a blinking light command for the location of the occurrence of an incident warranting police protection and a steady "on light" condition for each of the police cars in the area and observe the distance of each of the steady lights from the blinking lights so as to enable the operator to dispatch the nearest police car to the scene of the incident thereby aiding in making command and control decisions.

22. A positional location display system for visually displaying the position of a vehicle such as a police car on a map matrix comprising:

means for generating input signals representing "d" decimal digits of information relating to at least the positional coordinates of a motor vehicle such as a police car and a command instruction directing "light on" and "light off" status conditions;

priority encoding means for receiving said input signals representing said decimal digits of information and for sequentially encoding said input signals one digit at a time into binary coded decimal form, said priority encoding means producing a 1's, 2's, 4's and 8's binary bit respectfully for each decimal digit as it is encoded, said priority encoder means further including delay means responsive to the completion of encoding of each of said decimal digits for generating a shift pulse;

shift register means including a 1's position shift register for receiving and storing the units bit of each binary encoded digit of information entered into said priority encoding means, a 2's position shift register for receiving and storing the 2's bit of each binary encoded digit of information entered into said priority encoding means, a 4's position shift register for receiving and storing the 4's bit of each binary encoded digit of information entered into said priority encoding means, and an 8's position shift register for receiving and storing the 8's bit for each binary encoded digit of information entered into said priority encoding means, each of said shift registers having a separate stage and output for each of said "d" digits of information to be entered, each of said shift registers being coupled to said shift pulse-generating means and being responsive to the generation of a shift pulse indicative of the completed entry of a digit of information for shifting the stored contents of each of the "d" stages thereof to the next higher stage to enable said shift register to receive the binary representation of the next sequentially encoded digit of information, said shift register means further including a first counting means coupled to said shift pulse generating means for counting said shift pulses and generating a "last count" signal when "d" digits of information have been entered and "d" shift pulses counted;

first means coupled to the outputs of those shift register stages which ultimately store information for defining the "x" coordinates of positional location of said vehicle for generating a first "m" bit binary number representative of said "x" coordinate;

second means coupled to the outputs of those shift register stages which ultimately store information for defining the "y" coordinates of positional location of said vehicle for generating a second "n" bit binary number representative of said "y" coordinate;

third means coupled to the outputs of those shift register stages which ultimately store information for defining said command instruction for outputting "light on" and "light off" status condition commands;

a parallel-in/serial-out register coupled to the said first and second means for receiving in parallel an m+n bit sequence of binary bits representing the "x" and "y" coordinates of said vehicle and for serially outputting said m+n bit data sequence upon command;

clock means responsive to the generation of said "last count" signal for generating clock pulses at a predetermined rate;

a second counter means coupled to said clock means and said parallel-in/serial-out means for counting out exactly m+n of said clock pulses before disabling said clock means and outputting a "termination flag" pulse indicating that said m+n pulses have been counted, said parallel-in/serial-out register means being responsive to said m+n counted clock pulses for shifting out said m+n binary bits of stored data in response thereto;

serial-in/parallel-out means coupled to said clock means and said parallel-in/serial-out register means for serially receiving said m+n bit sequence of binary bits, said serial-in/parallel-out means including a set of "m" row outputs of outputting in parallel the first "m" binary bits of received data representative of the "x" coordinates of said vehicle and further including a set of "n" column outputs for outputting in parallel the next "n" binary bits of received data representative of the "y" coordinates of said vehicle;

a relatively high speed master clock for generating master clock pulses at a predetermined rate;

a $2^{m+n}$ binary up counter for counting said master clock pulses, said binary up counter having a first set of "m" row counter outputs and a second set of "n" column counter outputs, said first set of "m" row counter outputs corresponding to the first "m" consecutive lower ordered binary places while said second set of "n" column counter outputs correspond to the next higher ordered "n" consecutive binary places of said count;

row comparator means having a first set of "m" inputs coupled to the "m" outputs of said serial-in/parallel-out means and a second set of "m" inputs coupled to said first set of "m" row counter outputs of said binary up counter for comparing the binary number representation of the "x" coordinate which is stored on said "m" row outputs with the changing binary count on said "m" row counter outputs and for outputting a "row match" signal when equality exists;

column comparator means having a first set of "n" inputs coupled to the "n" column outputs of said serial-in/parallel-out means and a second set of "n" inputs coupled to said second set of "n" column counter outputs of said binary up counter for comparing the binary number representing the "y" coordinate which is stored on said "n" column outputs with the changing binary count on said "n" column counter outputs and for outputting a "column match" signal when equality exists;

gating means responsive to the generation of said "row match" signal, said "column match" signal and said "termination flag" signal for generating a "write command" signal;

a random access memory coupled to the row and column counter outputs of said binary up counter for sequentially scanning the row and column address locations thereof, said random access memory including an input for receiving said "lights on" and "lights off" command instruction and further including an input responsive to the generation of said "write command" signal for enabling said random access memory to write said command instruction into the address location then being scanned by said row and column counter outputs and further including output means for reading out the stored "lights on" or "lights off" command whenever said address location is scanned by said row and column counter outputs;

a matrix display of lighting means overlaid with a map representing the geographical area of concern to the user of the system, said matrix display having "a" rows of lighting means, each of said rows having "b" individual lighting means therein; and logic means responsive to said row and column counter outputs and to said random access memory output means for selectively lighting or not lighting the particular individual light means of the matrix display corresponding to the actual positional location of the vehicle which was previously entered into the system to provide a visual indication of the position of the vehicle for dispatch and control purposes.

* * * * *